US007938459B2

(12) United States Patent
Terry et al.

(10) Patent No.: US 7,938,459 B2
(45) **Date of Patent: *May 10, 2011**

(54) BOLT-TYPE SEAL LOCK HAVING LOCKING BODY AND SEPARATE MOUNTING HOUSING WITH ELECTRONICS FOR WIRELESS COMMUNICATIONS

(75) Inventors: Daniel J. Terry, Mill Creek, WA (US); Daniel Kenney, Mill Creek, WA (US)

(73) Assignee: Terahop Networks, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/347,658

(22) Filed: Dec. 31, 2008

(65) Prior Publication Data

US 2009/0115201 A1 May 7, 2009

Related U.S. Application Data

(63) Continuation of application No. 11/460,976, filed on Jul. 29, 2006, now Pat. No. 7,828,342, which is a continuation-in-part of application No. 11/193,300, filed on Jul. 29, 2005, now Pat. No. 7,438,334.

(51) Int. Cl.
*E05B 39/02* (2006.01)

(52) U.S. Cl. ..... 292/327; 292/307 R

(58) Field of Classification Search ..... 292/327, 292/307 R; 340/572.9; 70/55, 56
See application file for complete search history.

(56) References Cited

U.S. PATENT DOCUMENTS

| | | | | |
|---|---|---|---|---|
| 4,567,740 | A * | 2/1986 | Kelly | 70/55 |
| 4,750,197 | A | 6/1988 | Denekamp et al. | |
| 4,802,700 | A * | 2/1989 | Stevenson et al. | 292/327 |
| 4,826,027 | A | 5/1989 | Nilson | |
| 5,005,883 | A | 4/1991 | Guiler | |

(Continued)

FOREIGN PATENT DOCUMENTS

WO 2003095773 11/2003

OTHER PUBLICATIONS

Information Disclosure Statement (IDS) Letter Regarding Common Patent Application(s) submitted May 7, 2009.

(Continued)

*Primary Examiner* — Carlos Lugo
*Assistant Examiner* — Kristina R Fulton
(74) *Attorney, Agent, or Firm* — Tillman Wright, PLLC; Chad D. Tillman; Jeremy C. Doerre

(57) ABSTRACT

The system described here is a bolt-type seal lock which includes a bolt, having a shaft with proximal and distal portions and a head that is wider than the distal portion of the shaft and located at the proximal portion of the shaft; a locking body having a passageway with an open end for receiving and retaining the distal portion of the shaft of the bolt in locking engagement after the shaft has been inserted a predetermined extent into the open end of the passageway, at which point the shaft cannot be withdrawn from the open end of the passageway; and a housing connected to, and rotatable relative to, the locking body, configured to be removably mounted to a door of a shipping container, thereby preventing swinging motion of the locking body. The housing contains electronics, including memory, a wireless communication component, and a power source.

18 Claims, 19 Drawing Sheets

U.S. PATENT DOCUMENTS 5,097,253 A 3/1992 Eschbach
5,127,687 A 7/1992 Guiler
5,615,247 A 3/1997 Mills
5,656,996 A 8/1997 Houser
5,732,989 A 3/1998 Stevenson
5,761,935 A * 6/1998 Adelmeyer ..... 70/55
5,857,721 A 1/1999 Liroff
5,878,604 A 3/1999 Stone et al.
6,009,731 A 1/2000 Emmons et al.
6,166,627 A 12/2000 Reeley
6,265,973 B1 * 7/2001 Brammall et al. ..... 340/568.1
6,339,397 B1 1/2002 Baker
6,407,666 B1 6/2002 Debrody
6,420,971 B1 7/2002 Leck et al.
6,464,269 B1 * 10/2002 Wilhelm et al. ..... 292/307 R
6,467,316 B1 * 10/2002 Chen ..... 70/56
6,536,815 B1 3/2003 Liroff
6,747,558 B1 * 6/2004 Thorne et al. ..... 340/551
6,813,914 B2 * 11/2004 Chen ..... 70/50
6,870,476 B2 * 3/2005 Cockburn et al. ..... 340/541
6,882,274 B2 * 4/2005 Richardson et al. ..... 340/539.13
6,932,629 B2 * 8/2005 Ikenoue ..... 439/138
7,046,138 B2 * 5/2006 Webb, Sr. ..... 340/539.13
7,148,800 B2 12/2006 Cunningham et al.
7,178,369 B2 2/2007 Azzalin
7,239,238 B2 7/2007 Tester et al.
7,283,052 B2 * 10/2007 Bohman et al. ..... 340/572.1
7,333,015 B2 2/2008 Ekstrom
7,339,469 B2 * 3/2008 Braun ..... 340/539.13
7,360,806 B2 4/2008 Ching
7,382,251 B2 6/2008 Bohman et al.
7,472,933 B2 * 1/2009 Weedon et al. ..... 292/307 A
2002/0074811 A1 6/2002 Kuenzel
2003/0189491 A1 * 10/2003 Ng ..... 340/572.9
2004/0041705 A1 * 3/2004 Auerbach et al. ..... 340/539.22
2004/0100379 A1 * 5/2004 Boman et al. ..... 340/539.26
2004/0113783 A1 * 6/2004 Yagesh ..... 340/568.1
2004/0119588 A1 6/2004 Marks
2005/0073406 A1 4/2005 Easley et al.
2005/0088299 A1 4/2005 Bandy et al.
2005/0128080 A1 6/2005 Hall et al.
2005/0212671 A1 9/2005 Auerbach et al.
2005/0219037 A1 10/2005 Huang
2006/0158326 A1 7/2006 Easley
2006/0164232 A1 7/2006 Waterhouse et al.
2006/0170560 A1 8/2006 Auerbach
2006/0202824 A1 * 9/2006 Carroll et al. ..... 340/568.1
2007/0032951 A1 2/2007 Tanenhaus et al.
2007/0069528 A1 * 3/2007 Kuenzel ..... 292/315
2008/0094209 A1 * 4/2008 Braun ..... 340/539.13
2008/0315596 A1 12/2008 Terry et al.
2009/0026773 A1 1/2009 Terry et al.

OTHER PUBLICATIONS

Information Disclosure Statement (IDS) Letter Regarding Common Patent Application(s), submitted by Applicant on Mar. 23, 2010.

* cited by examiner

BOLT-TYPE SEAL LOCK HAVING LOCKING BODY AND SEPARATE MOUNTING HOUSING WITH ELECTRONICS FOR WIRELESS COMMUNICATIONS

CROSS-REFERENCE TO RELATED APPLICATIONS

The present application is a continuation of, and claim the benefit under 35 U.S.C. §120 to, U.S. patent application Ser. No. 11/460,976 filed on Jul. 29, 2006 (the '976 application), which '976 application in turn is continuation-in-part of, and claim the benefit under 35 U.S.C. §120 to, U.S. patent application Ser. No. 11/193,300 filed on Jul. 29, 2005 (the '300 application). The contents of the '976 application, the '300 application, and any published patent applications and issued patents thereof, are incorporated herein by reference, including U.S. patent application publication no. US 2008/0315596 and U.S. Pat. No. 7,438,334.

TECHNICAL FIELD

The invention disclosed here generally relates to shipping container security systems. More particularly, it relates to shipping container security systems that provide both security and shipping information at the same time. The '300 application discloses an improved bolt-type seal, or seal lock, that is both recyclable and carries data storage capability. The design disclosed here is more expansive in terms of utility and functionality. On the one hand, this document updates the design of the bolt-type seal lock disclosed in the '300 application, consistent with applicants' ongoing development activities. On the other hand, the bolt-type seal lock described here is a component in a broader security system, with the mechanical lock functioning in combination with one or more electronic sensor modules that acquire container security data and have the capability to transmit data via wireless means.

BACKGROUND OF THE INVENTION

Large numbers of containers are used to ship goods on a worldwide basis. Container shipping creates issues relating to both supply chain management and security. For a supply chain manager, having instant access to information that identifies a container's whereabouts is important for both inventory management and predicting customer delivery. Container security is obviously important from the standpoint of knowing whether or when security is breached.

Shipping containers are manufactured according to international standards that have encouraged generically designed containers that can be carried by ships, handled at international ports, and easily transferred to truck or rail. Container doors are typically sealed for security purposes. However, it is relatively easy to breach container security by either cutting the door seal; bypassing the seal entirely by cutting or removing door hasp structure; or by simply cutting a hole through the side of the container with a cutting torch.

Because of the sheer volume of containers in use today, it is not practical to physically inspect each one as they cross borders or change hands from one shipper to the next. It is estimated that only 2 to 30% of containers are physically inspected when they enter the United States, for example.

Container security is obviously a problem before entry into the United States in the first place. However, once inside the United States, containers are often temporarily stored in various transit locations where they can be accessed and broken into (transit centers, railyards, etc.). All of these various factors create an ongoing situation where a security breach is often not identified or recognized until the container reaches the destination where it is supposed to be unloaded.

It is presently not possible to prevent unauthorized entry into a container. However, knowing whether a container has been entered (whether entry is authorized or unauthorized), when it was entered, and where, is useful information to a shipper, over and above simply keeping track of the container's location on an ongoing basis. The system described here provides a different arrangement of components for providing the means to monitor container security along these lines.

The replacement costs for bolt-type seal locks is an ongoing issue for those shippers who handle large numbers of containers. Leaving aside the ongoing expense of cutting and discarding bolt-type seal locks when a container reaches its final destination, there are many legitimate reasons why the bolts need to be cut at an earlier point in time, for temporary entry into the container, due to customs inspections or other supply chain reasons. Therefore, in addition to describing an overall security system, what also follows below an improved design for the mechanical aspects of the locking structure in the seal lock—that enables bolt-type locks to be cut and reused or recycled at the place where they are cut.

SUMMARY OF THE INVENTION

The invention disclosed here is an improved bolt-type seal lock and security system for use with shipping containers.

The bolt-type seal-lock described here has a conventionally-shaped bolt with a head that is inserted into a locking body. The bolt's head is wider than the end so that the bolt cannot be pulled through a hasp or similar locking structure on a container door, once the bolt is inserted into the locking body.

The locking body has a passageway for receiving the end of the bolt and holding it in place—which is typical to bolt-type seal locks. However, in this instance, the passageway extends all the way through the length of the locking body so that, when the bolt is cut, the bolt's cut end can be pressed or pushed out through and from the locking body. The internal locking structure permits this without changing or having to replace any other internal locking components, other than the bolt itself, and an ID tag that is included as part of the overall seal lock module. As a consequence, a container can be opened and relocked by an inspector so long as the inspector has a replacement bolt and ID tag, as per the design described here.

The bolt has a pre-printed serial number that matches the serial number on the ID tag. The bolt itself additionally carries an electronic circuit and a chip that has the serial number electronically stored on it. This information is transmitted to a memory storage device that is attached to the bolt-type seal lock—either directly or indirectly in ways that are described below. The electronic circuit (on the bolt) enables a signal to be generated or created when the bolt is cut and/or for the chip to transmit the next serial number to be read into memory when a new bolt is installed.

The bolt and locking body design described here could be used independently on a stand-alone basis. However, it is also described here as a part or component of a module, or an "electronic seal lock module," that is mounted to the outside of a shipping container. The electronic seal lock module, as a unit, is intended to replace the conventional bolt lock in use today and serves as both the locking mechanism for the door and a source of electronic information of all kinds. Therefore, the electronic seal lock module creates a unique, microprocessor-based unit that has both physical locking and data storage capability. It may be built to include a variety of sensors for detecting environmental conditions external to the container body, such as motion and vibration, temperature and humidity, if desired.

The module's data storage capability is in the form of flash memory, or something equivalent, and enables the module to store sensor data on an ongoing basis, as well as storing bolt and ID tag serial numbers, shipping information, customs documentation, computer applications, audio and visual files, or any other form of computer data files. Most importantly in terms of the security function this design provides, the module's data storage capability allows it to store bolt serial numbers, as bolts are installed, or store information about when each bolt is cut.

As indicated above, the physical locking portion of the electronic seal lock module (i.e., the bolt and the bolt's corresponding locking body) is an improved version relative to what was described in the '300 application. Nevertheless, the bolt and locking body appear to be conventional on the outside, leaving aside any applicable electronics component. That is, the locking body has an opening for receiving the end of the bolt and an internal locking mechanism, within the locking body, for engaging with the bolt's end. What is outwardly different is that the locking body is connected to an electronics box by means of a rotational pin (that is, the locking body and electronics box integrate together to create the complete seal lock module).

As described above, the bolt itself carries an electronically addressable serial number circuit that assigns a unique serial number to each individual bolt. Upon insertion of the bolt into the locking body, the electronic serial number is automatically identified, or read, and logged into a data storage device that is integral to the electronic seal lock module as part of the electronics box attached to the locking body. Once installed, the only manner in which the bolt can be removed is to cut the head off the bolt. After the head is cut, the remnant of the bolt may be pressed through the locking mechanism (inside the locking body) and out the bottom of the lock housing, thereby preparing the lock for insertion of a new bolt. Cutting the bolt also cuts the electronic circuit just described. This is a detectable event that can similarly be logged in data storage inside the electronics box.

Another optional component of the system is a separate and independent "container" sensor electronics module that is mounted to the inside of the shipping container. This optional electronics module is physically independent of the electronic seal lock module mounted to the door, although both modules, or system components, would wirelessly interact with each other if both are used at the same time.

The container sensor electronics module has either an internal or external antenna (whether it is internal or external depends on specification security application or need). Like the electronic seal lock module described above, the container sensor module is a microprocessor-based unit with its own data storage capability—which means that it is essentially a redundant unit to the electronic seal lock module. However, in contrast to the electronic seal lock—which is mounted as a lock to container door structure on the outside—the container sensor electronics module may contain a variety of sensors for detecting environmental conditions inside the container such as motion, vibration, impact, temperature, humidity, presence of light, or nuclear and biological material detection devices (to detect unauthorized access and placement of dangerous materials for security reasons), if desired.

As just indicated, each of the two modules described above (i.e., the electronic seal lock module on the door and the container sensor electronics module on the inside) are redundant in that each contains or receives rewritable data storage devices within the body of the module. These devices enable the modules to store the same shipping or transportation data, as well as any sensor or other applicable data electronically, in the manner described above, as the modules travel with the shipping container.

Each module can be individually addressed by means of an external reader or handheld device, if desired. However, since each of the two modules also contains a wireless modem that allows for data exchange between the two modules, downloading information from one module will include any information that is uniquely generated by the other. Moreover, either one of the two modules, or perhaps even both, could function as the overall control device for a container electronics suite (i.e., either one could be a master or slave) if these modules are integrated together as a system intended to function with each other, or with a broader network (e.g., a satellite uplink to a central data base).

Another optional component of the system is a RF-based wireless communications radio for creating a short-range link to a similar radio contained within the "container sensor electronics module." This link activates when the container door is closed and serves to provide an independent alarm if the door is opened without correct authorization from the sensor module. In other words, this link indicates opening and closing movement of a container door regardless of what happens with the bolt on the door. The RF door alarm module is specifically coded with the container sensor module so that outside devices cannot "spoof" the connection and bypass the door alarm such, as can be the case with the commonly used magnetic proximity detectors or physical switches.

Finally, in accordance with the various system components described here, it is possible to use either the electronic seal lock module or the container sensor module as part of a system that creates a method for transmitting data from a shipping container that is stacked within a group of shipping containers to a receiver outside the group of shipping containers. When large numbers of metal containers are stacked together, the metal in the containers will interfere with the transmission of wireless signals from those containers buried deeply within the stack. In this instance, either the electronic seal lock module or the container sensor module creates a wireless transceiver for each shipping container. These individual transmitters can be networked together so that any data resident with a specific shipping container that is stacked or buried deeply within the group can communicate to a reader on the outside of the group by relaying the wireless connection through other containers that are stacked closer to the outside of the shipping container stack. From the external reader, the information may be relayed over conventional data transmission sources such as satellite communications modems, cellular data networks, wired or wireless networks, or through standard wireless modem connections.

Further details of the components summarized above are disclosed and described below, with the following text to be read in conjunction with the attached drawings.

BRIEF DESCRIPTION OF THE DRAWINGS

In the drawings, like reference numerals and letters refer to like parts throughout the various views, and wherein:

FIG. 22 is a schematic view of a networked system for keeping track of stacked containers on a cargo vessel or the like;

BEST MODE FOR CARRYING OUT THE INVENTION

Figure 3:
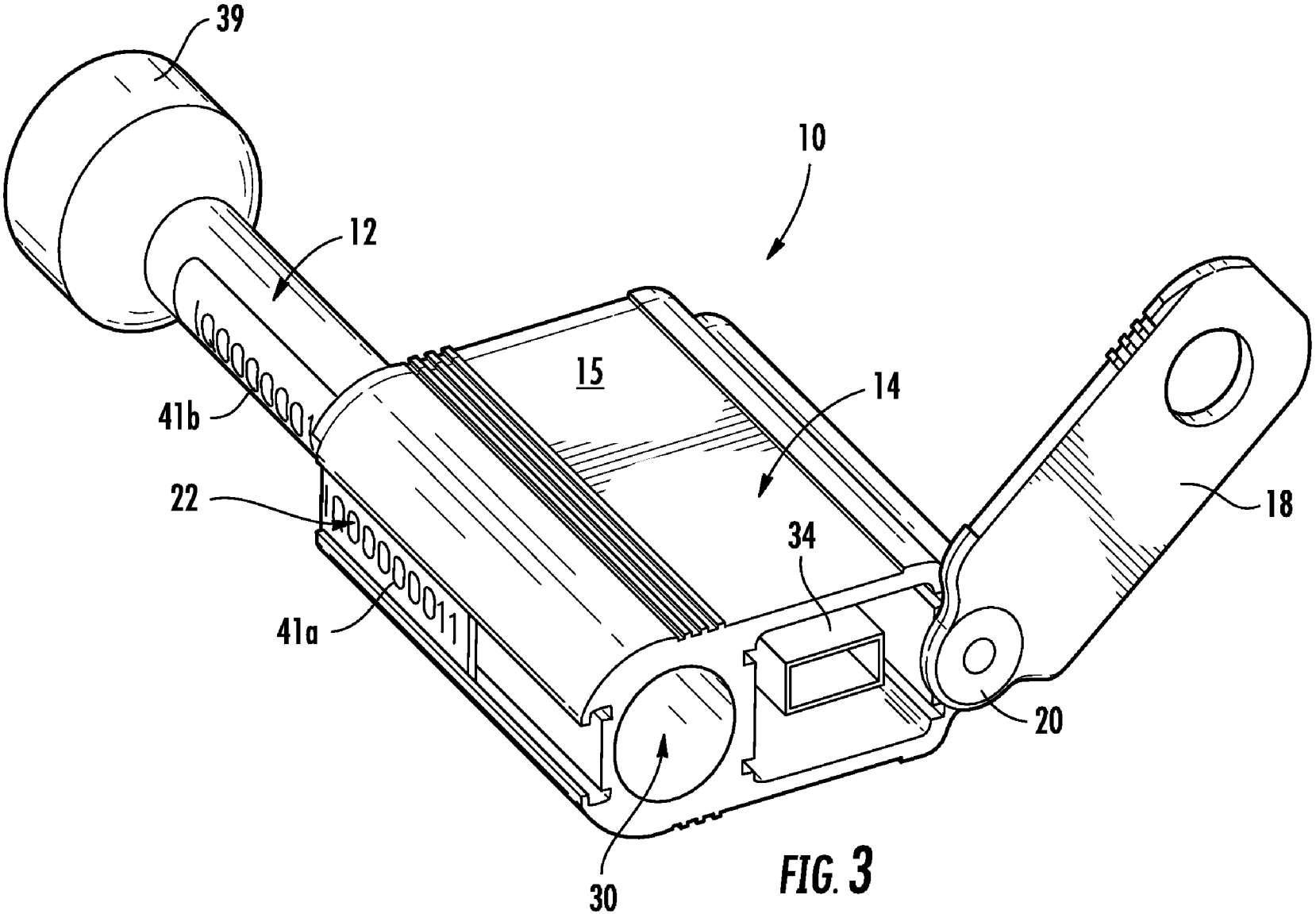
FIG. 3 is a pictorial view of a bolt-type seal lock having an improved bolt and locking body housing relative to the '300 patent application.

Referring now to the drawings, and first to FIG. 3, shown generally at 10 is a seal lock that is an improved version of the seal lock disclosed in the '300 application. Like the older one, the improved version 10 has a bolt 12 and a locking body 14. The bolt 12 is a hardened bolt, with further details of the bolt to be described below.

Figure 4:
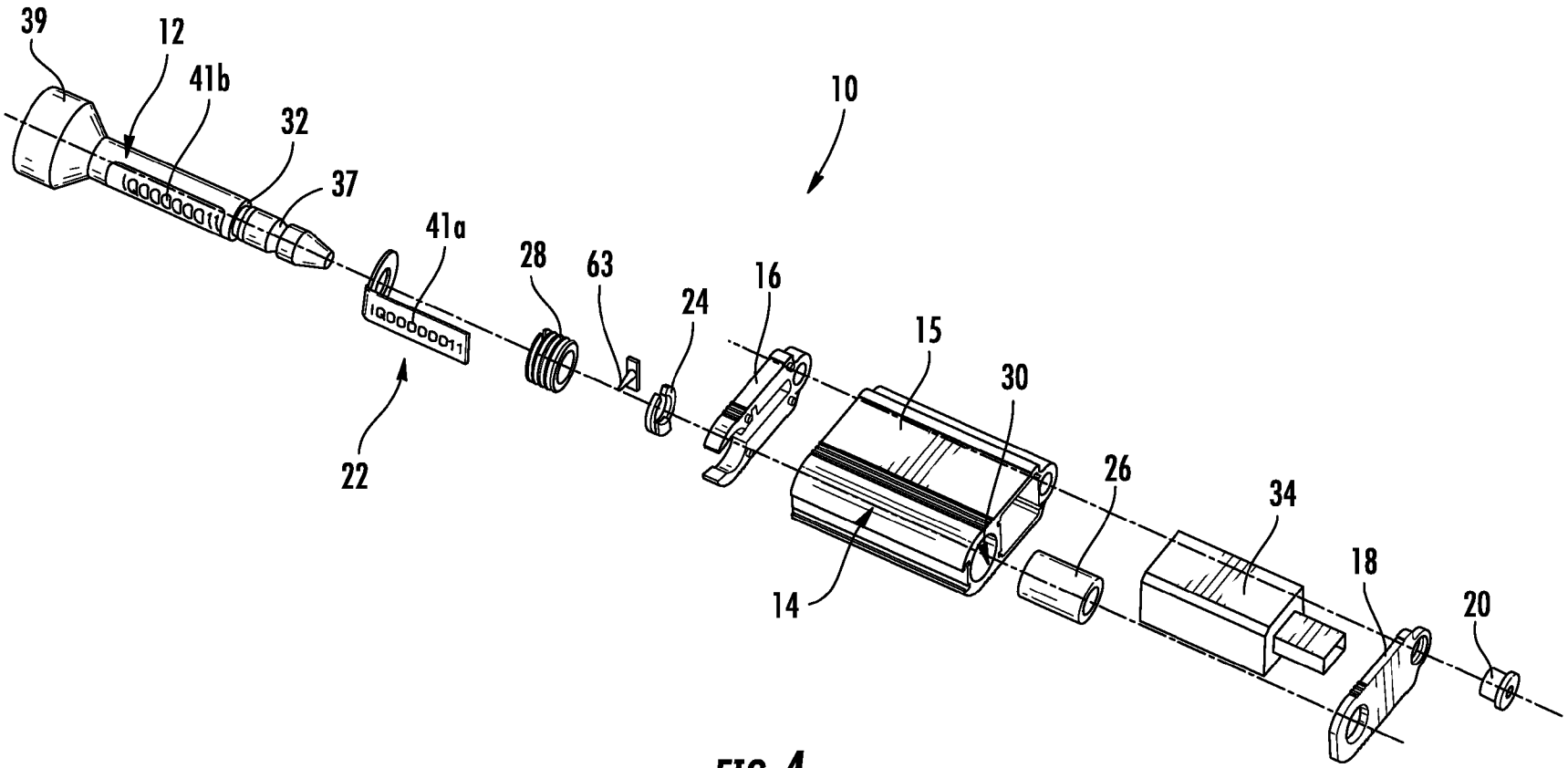
FIG. 4 is an exploded view of the seal lock shown in FIG. 3.

In this instance, relative to the '300 application, the locking body 14 illustrated here has a modified housing made from a single piece 15 of extruded aluminum (see FIG. 4). There may be other and better ways to manufacture the housing 15 for cost reasons, which may result in the housing being made from different materials. However, the specific method of manufacture and materials used are not particularly relevant to the various components described here.

Figure 6:
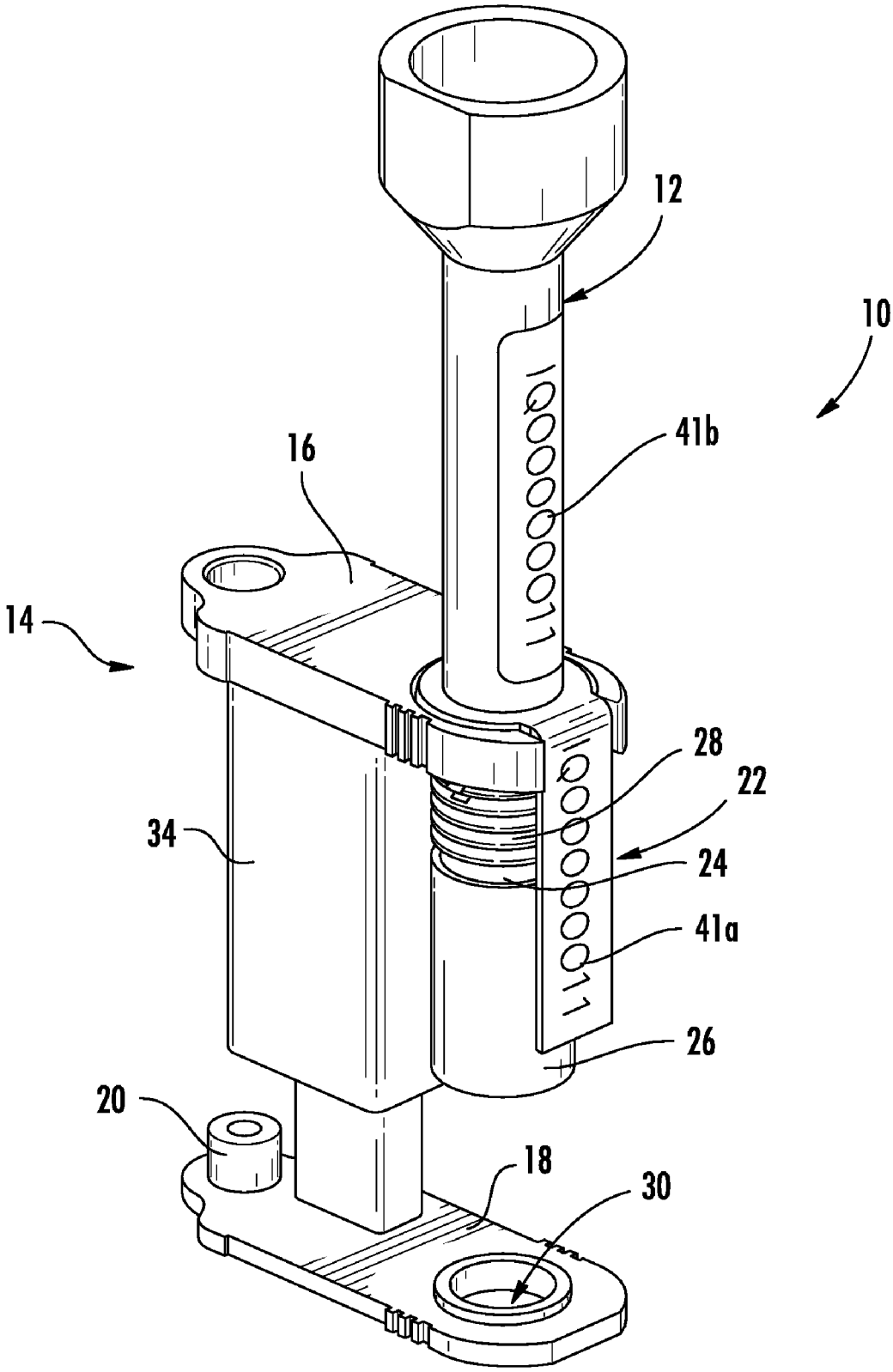
FIG. 6 is a view of the seal lock shown in FIGS. 3, 4 and 5, but with the outer surface of the locking body removed.

The body 14 has an end plate 16 on the upper side (see FIGS. 6 & 7) that receives the bolt 12 and a second end plate 18 on the opposite side. The second end plate 18 may swivel about pivot 20 to allow access into the seal lock's housing 14 (see FIGS. 4 & 6).

Figure 7:
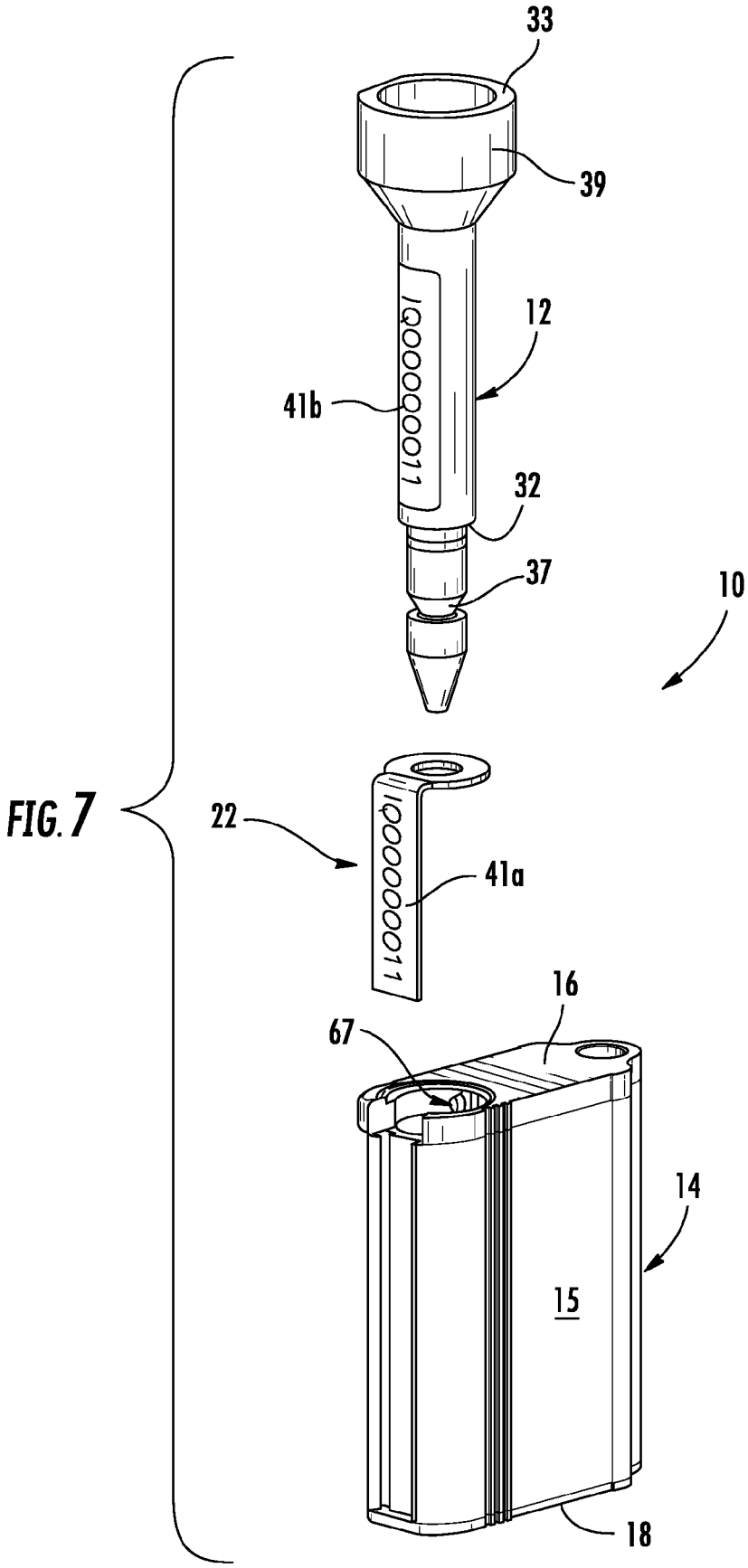
FIG. 7 is a pictorial view of the seal lock shown in FIGS. 3-6, but with an ID tag and bolt exploded from the locking body.

A metallic ID tag, generally illustrated at 22 in FIG. 7, is used in the same way here as in the '300 application. However, in this instance, the ID tag 22 does not cover access to a locking spring inside the seal lock 10. Instead, it simply provides a way for re-marking a serial number on the locking body 14, when the seal bolt 10 is recycled (after the bolt 12 is cut) and a new serial number is needed for the corresponding serial number on the replacement bolt.

In this new embodiment, the internal locking structure has been altered relative to the '300 patent. The bolt 12 is held in place by a snap ring 24 (see FIGS. 4 and 5). The snap ring 24 is retained or held in place on one side by a hollow cylinder 26 and on the other side by a threaded plug 28.

The hollow cylinder 26 is slipped or slid into the housing through a bore 30 and held in place by either press-fitting or gluing it permanently in place. In this improved version, after the bolt 12 is cut, the seal lock 10 is refurbished by pressing the remnants of the bolt 12 past the snap ring 24 and out the bottom side of the housing, at 30. The cylindrical bore 30 provides a passageway from end-to-end through locking body 14 for this purpose.

The ID tag 22 is also replaced with a new one having a serial number that matches the replacement bolt. The ID tag 22 slides into the housing 15 in the same way previously described in the '300 application. It might be held in place by a very low strength adhesive so that it does not fall from the housing prior to use. In use, the bolt 12 is inserted in the housing 15 and a shoulder 32 on the bolt (see FIG. 5) holds the ID tag 22 in place, in the same way previously described in the '300 patent application.

Figure 10:
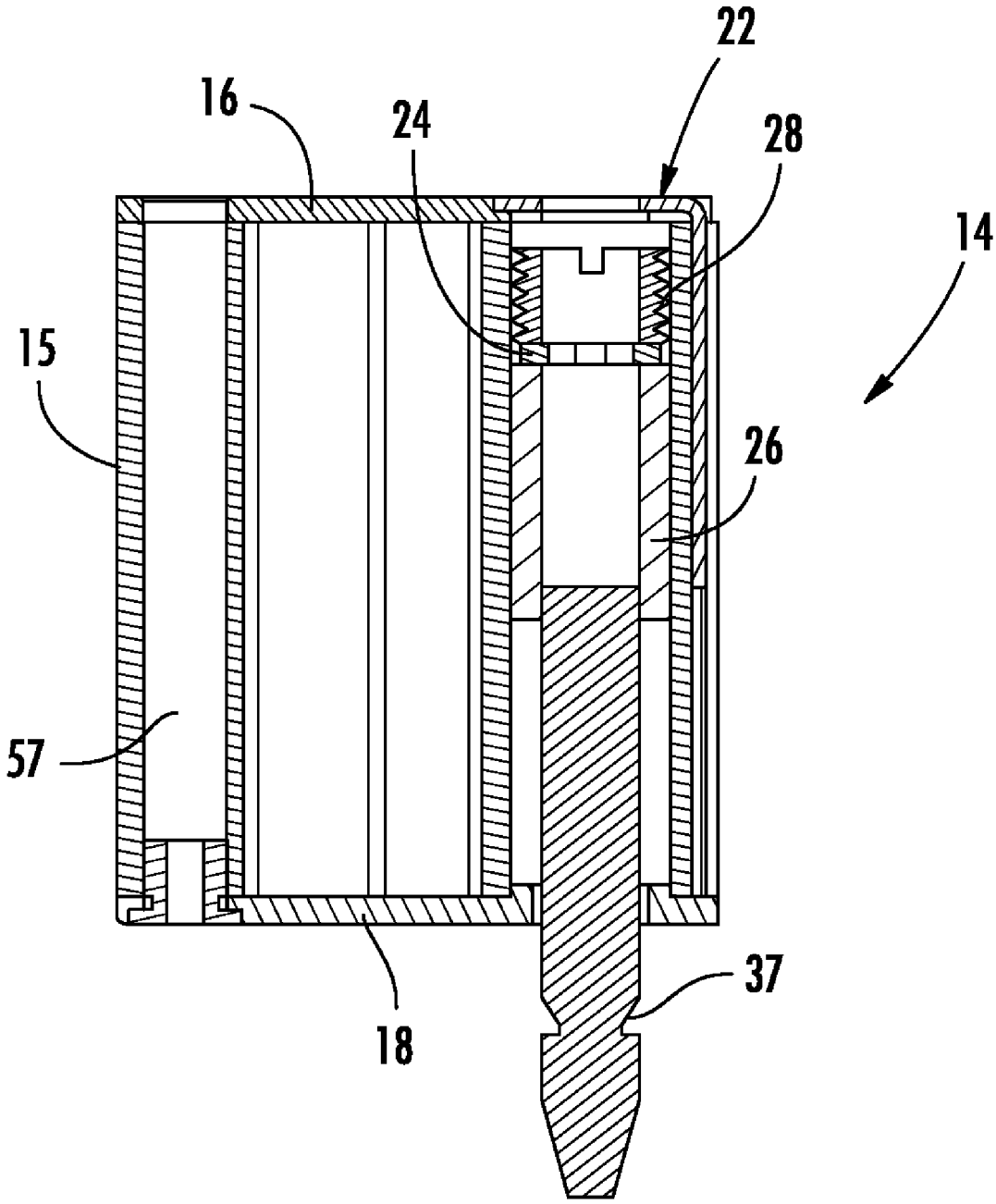
FIG. 10 is a cross-sectional view of the locking body portion of the seal bolt, and illustrates how the cut end of a bolt is pressed through the locking body.
Figure 13:
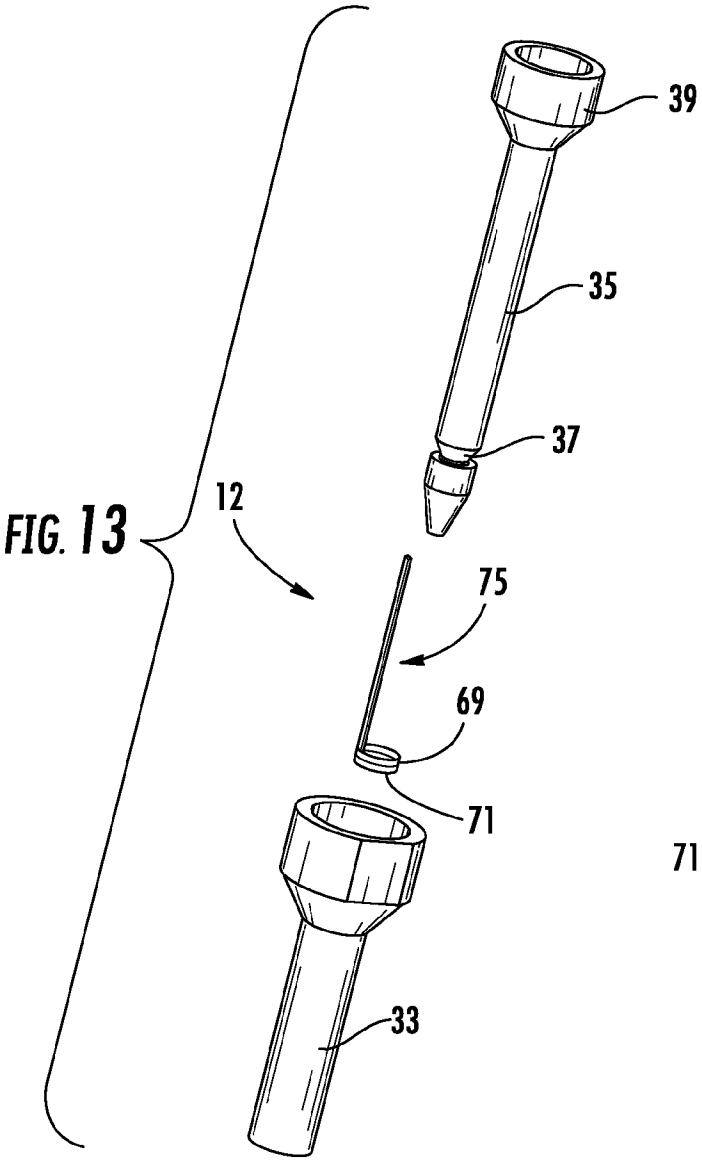
FIG. 13 is an exploded view of the bolt showing how an electronic serial number circuit is put on the bolt.

The above design represents a departure from the '300 patent application in that it essentially enables the bolt portion of the seal lock 10 to be "recycled" by the person who cuts the lock, if desired. The shoulder 32 is created by a plastic cover 33 that surrounds the hardened metal portion 35 of the bolt 12 (see FIG. 13 for example; and FIG. 5). The snap ring 24, which prevents the bolt 12 from being pulled from the locking body 14 after insertion, will ride over the sloped part 37 of the bolt's end, as the end is pushed out through the bottom of the housing, as indicated at 30. The bolt 12 is obviously cut somewhere above that point, to sever the bolt's head 39 from the rest of the bolt. When that happens, the remnants of the sheath 33 shear away from the metal part 35 of the bolt as the bolt is pushed down through the housing (see FIGS. 10 and 11, for example). This, of course, also shears away plastic shoulder 32, which normally holds the ID tag 22 in place.

After the user removes the bolt 12 in the above way, all the user needs is a new bolt and ID tag to reinstall the seal lock 10 on the container. The user can be provided with replacement packages of bolts and matching ID tags (the bolt and ID tag serial numbers matching, that is, as shown at 41A and 41B in FIG. 7), for the purpose of "recycling" the same seal lock 10 in a rail or shipping yard, or any other location where it is desired to open and then reseal a shipping container. The instant design, also provides a way to automatically identify when the bolt 12 is cut and/or to identify the serial number of the replacement bolt when it is installed. This will be described further below.

Figure 5:
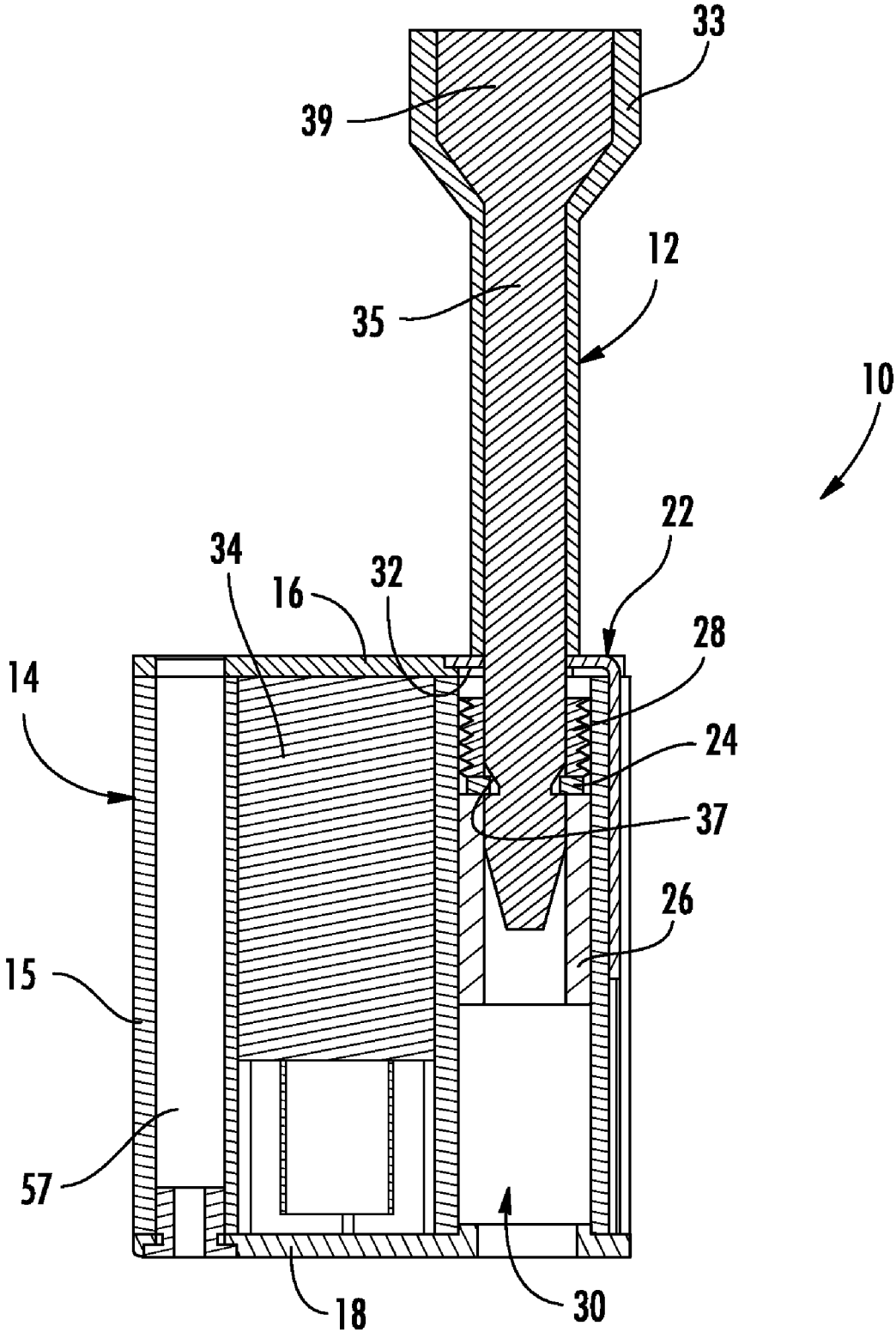
FIG. 5 is a cross-sectional view of the seal lock shown in FIGS. 3 and 4.

In the design described here, the locking body's housing 15 is enlarged slightly to carry a larger internal electronics module 34 (see FIGS. 4 and 5, for example). Like in the earlier version, the lock seal's electronics module 34 may include a flash memory for data storage, in the same way previously described in the '300 application. In this instance, however, the electronics module is further equipped with conventional wireless capability as an option, as schematically indicated at 35 in FIG. 23. This type of functionality is easy to implement via a standard 2.4 GHz modem that runs at low power levels. A power source will be included with the electronics module 34. Components like the electronics module 34 are easy to obtain on a customized basis from companies like Cypress Semiconductor in San Jose, Calif.

Figure 8:
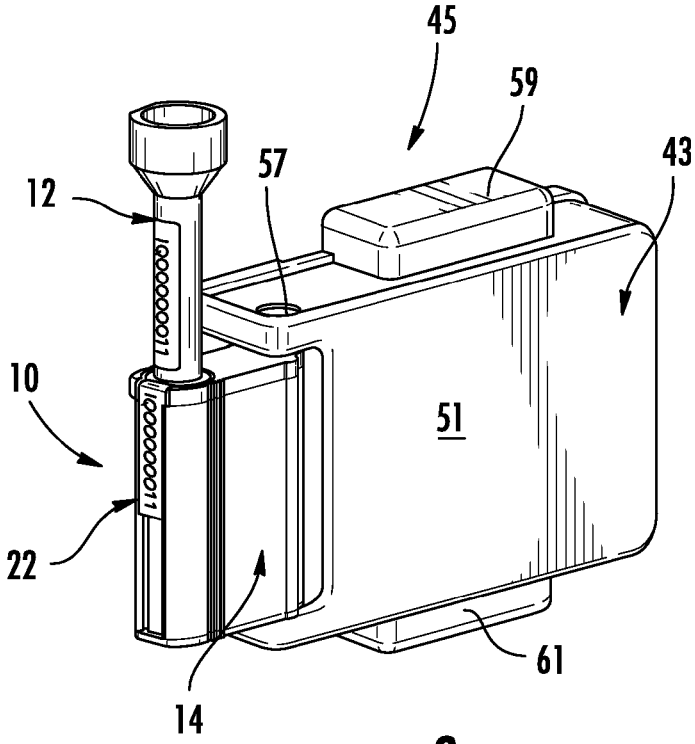
FIG. 8 is a pictorial view of the entire electronic seal lock module shown in FIGS. 1 and 2, and illustrates how the mechanical seal lock shown in FIGS. 3-7 is connected as a part to an electronics box to make an integrated electronic seal lock module.
Figure 9:
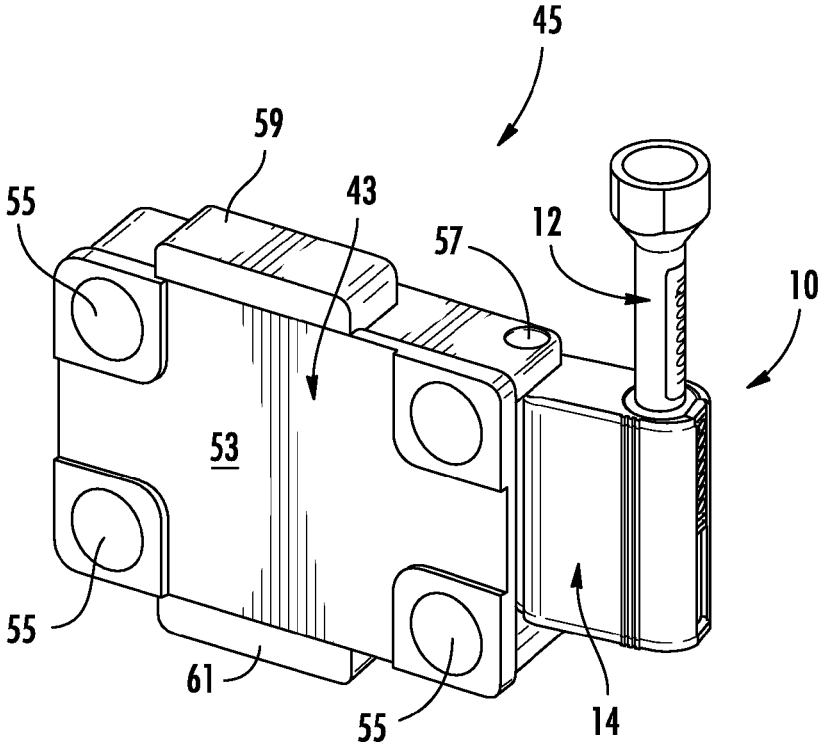
FIG. 9 is a pictorial view of the electronic seal lock module, looking at the aft side relative to FIG. 5.
Figure 12:
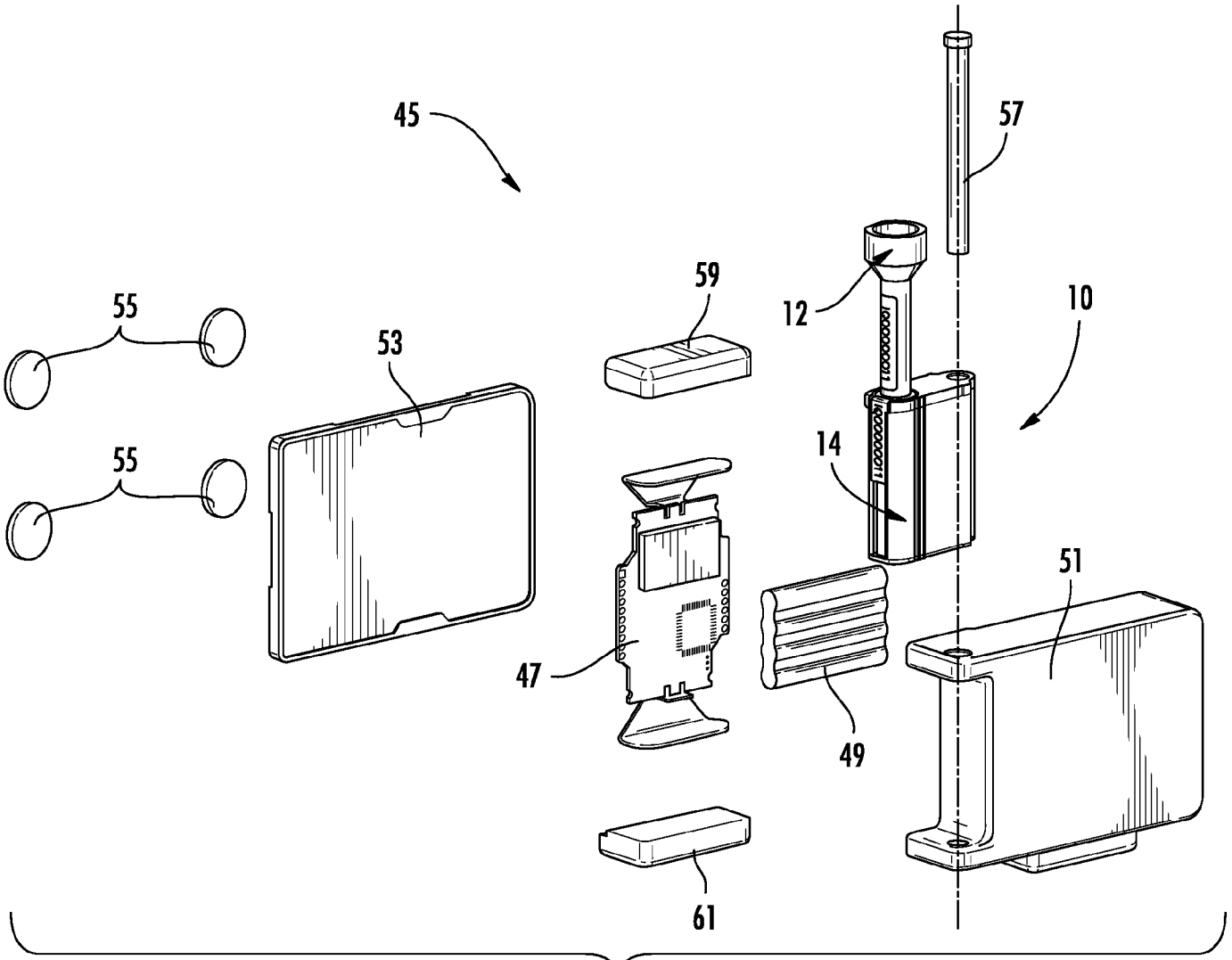
FIG. 12 is an exploded view of the electronic seal lock module.

As will be further described later, the mechanical bolt-type seal lock 10 attaches to a cast aluminum housing 43 (which serves as an electronics box) that completes the entire electronic seal lock module (the complete electronic seal lock module is indicated generally at 45 in the various Figs.). As previously indicated, the electronic seal lock module 45 functions as the lock for a container door. How the electronics housing 43 connects to and integrates with the seal bolt 10 to create the overall electronic seal lock module 45 is best seen in FIGS. 8 and 9, with an exploded view also being presented in FIG. 12.

The box 43 contains an electronics board 47 powered by a battery pack 49. The electronics board 47 carries a wireless modem that enables the electronics seal lock module 45 to communicate with various other components of the system described here.

Figures 1, 2:
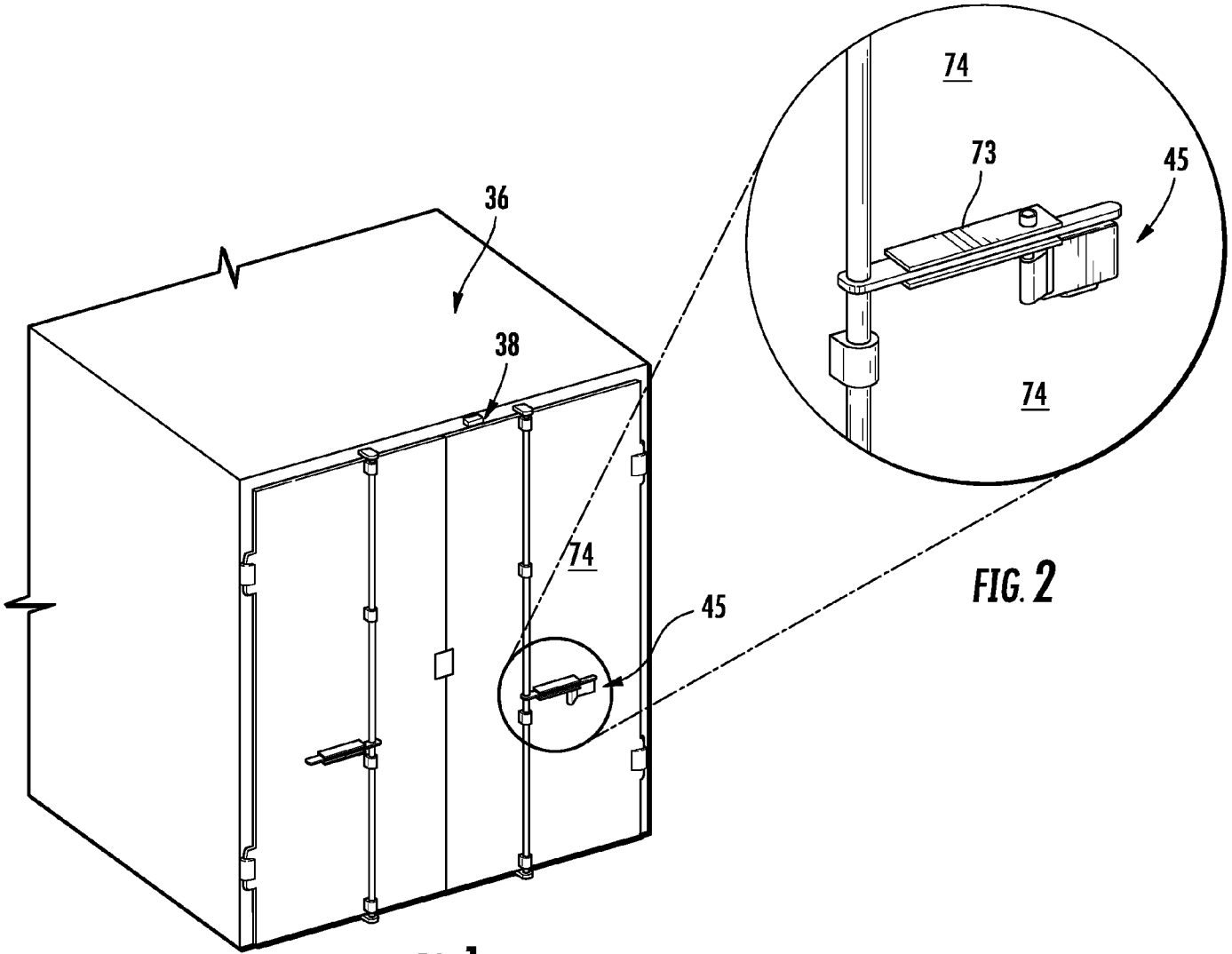
FIG. 1 is a pictorial view of an end of a shipping container with the door closed, and shows the position of an electronic seal lock module for locking the door; a container sensor electronics module on the container, and the position of a RF door seal.
FIG. 2 is an enlarged pictorial view of the electronic seal lock module shown in FIG. 1.

Referring now to FIGS. 1 and 2, the electronic seal lock module 45 generally provides overall control and system functionality as will be described in additional detail below. It will have its own microprocessor based processing capability for handling sensor information and data of all kinds, which includes its own flash memory that is independent of any flash memory contained within the housing 15 of the locking body 14 (i.e., electronics module 34) on the bolt-seal 10. All of these various components inside the electronic seal lock module 45, including environmental sensors (temperature, humidity, impact or shock, etc.) can be placed on the electronics board 47, inside housing 43.

The housing 43 itself is made from two aluminum or plastic castings 51, 53 that form a weathertight housing or box in which the electronics board 47 and batteries 49 are contained. The housing 43 also carries permanent magnets 55 that connect the housing to the face of the container door 74, just below the door's locking handle 73 (see FIGS. 1 and 2).

The bolt portion 10 of the electronic seal lock module 45 is free to rotate about a pin 57 relative to the weathertight box or housing 43, so that the bolt 12 can be easily placed through corresponding holes in container door handle and related structures, all of which are conventional in design and would be familiar. The magnets 55 then connect the module's housing 43 to the container door 74 so that it does not swing during container transport.

Figure 11:
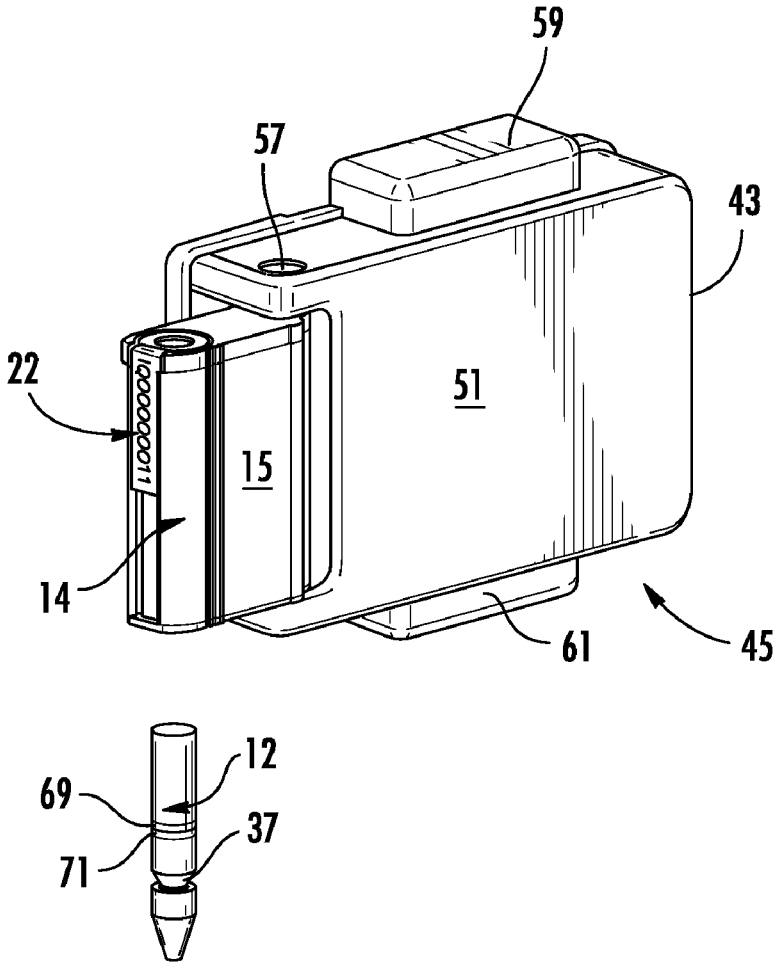
FIG. 11 is similar to FIGS. 8-10 and illustrates how the cut end of a bolt is pushed through and dropped from the electronic seal lock module when a container is entered by an inspector.

Referring to FIG. 11, the electronic seal lock's wireless capability is provided by two wireless antennas 59 and 61 that protrude from upper and lower sides of housing 43. These antennas are integrated with the interior electronics board 47 (see FIG. 12).

Figure 16:
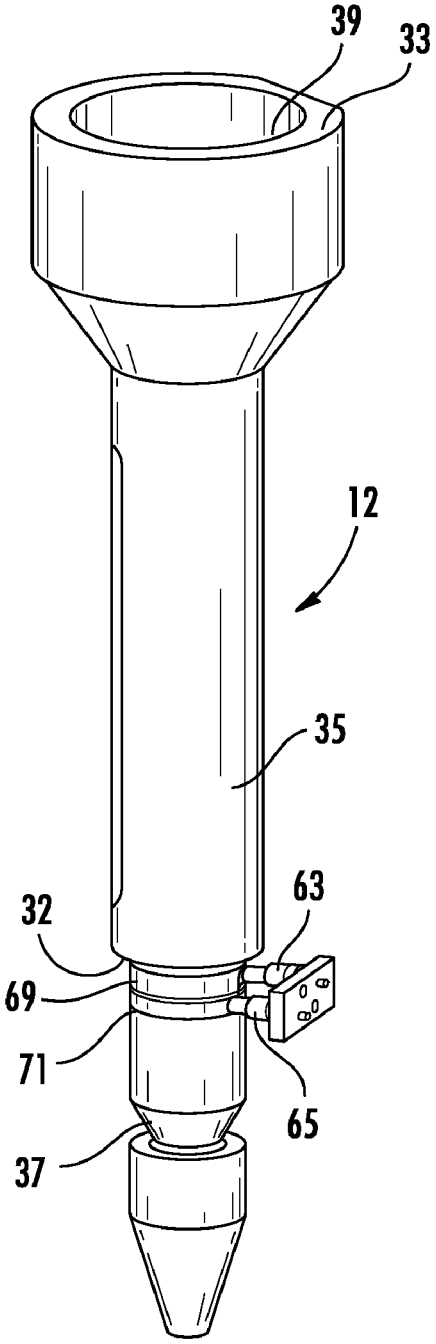
FIG. 16 is a pictorial view that shows how the electronic serial number circuit shown in FIG. 13 is put into electrical contact with an electronics board in the electronic seal lock module.
Figure 17:
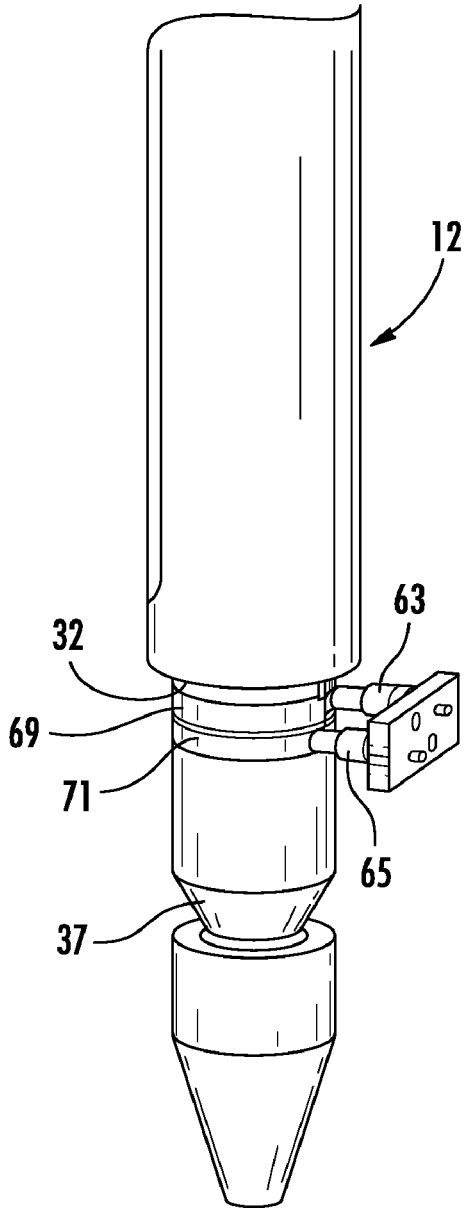
FIG. 17 is an enlarged view of FIG. 16 and shows just the end of the bolt.

A set of wires (not shown in the figures) will extend from the electronics board 47, through a sealed hole in the side of the housing 43, and into a corresponding hole in the side of the seal lock body 14. These wires will terminate in two spring pin contacts 63, 65 (see FIGS. 16 & 17) that reside just below the top part of the ID tag 22 when it is in position in lock body 14. This location can be seen at 67 in FIG. 7. These spring pin contacts 63, 65 are positioned so that, when the bolt 12 is inserted into the locking body 14, they make electrical connection with two annular contact patches 69, 71 on the end of the bolt (see FIGS. 16 & 17).

Figure 14:
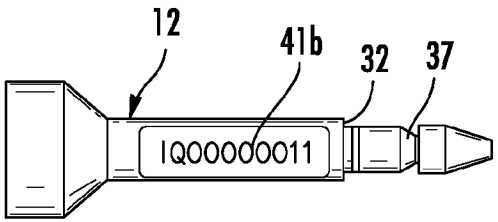
FIG. 14 is a side view of the bolt.
Figure 15:
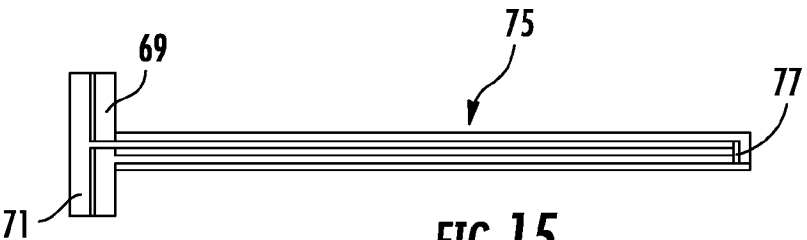
FIG. 15 is a side view of the electronic serial number circuit shown in FIG. 13.

The annular contact patches 69, 71 are made from a flexible circuit board material that is die cut into a shape to match the contour of the bolt 15 (see, generally, 75 in FIG. 15). The flexible circuit board 75 is fabricated using common circuit board fabrication techniques with the two above mentioned annular contact patches 69, 71 terminating in two circuit leads that traverse the length of the flexible circuit board 75 and are then bridged by a silicon microchip 77. The silicon microchip 77 electronically contains the serial number of the bolt 12 (see 41 in FIG. 14).

When the bolt 12 is assembled, the annular contact patches 69, 71 are placed on the exposed metallic end 79 of the bolt so they are not covered by the bolt's plastic cover 33. The remaining part of the flexible circuit board 75 (and the microchip 77) underlies the plastic cover such that it is not normally visible. Subsequent insertion of the bolt's end into the bolt's locking body 14 (to the point where it is captured by snap ring 24 (the position shown in FIG. 5, for example)) brings the annular contact patches into electrical connection with the spring pin contacts 69, 71. This sets up an electrical circuit with the electronics board 47 inside the electronics housing 43 of the electronic seal lock 45 so that the bolt's serial number (electronically stored in the microchip 77) is transmitted into data storage on that board. In this way, the serial number of the bolt is "read" and stored at the time it is inserted. Moreover, the electronics board 47 in the module 45 continuously monitors this connection. Thus, when the circuit connection is terminated, due to cutting of the bolt 12, or for any other reason, this event is recorded by the electronics board 47 and stored in memory for later reading or transmission.

Electronic schematics for the board 47 would not be needed to construct it. This type of board, along with the various sensor functions described here, and the wireless capability (typically a 2.4 GHz wireless modem—with the signal output via the antenna blocks 59, 61) can be easily custom built as a fully integrated unit by companies such as TeraHop of Alpharetta, Ga. One only needs to understand the concept of wanting to incorporate sensors capable of sensing desired data concerning environmental conditions on the outside of the container, and wireless and storage capability. TeraHop manufactures integrated electronics of this kind.

Figure 19:
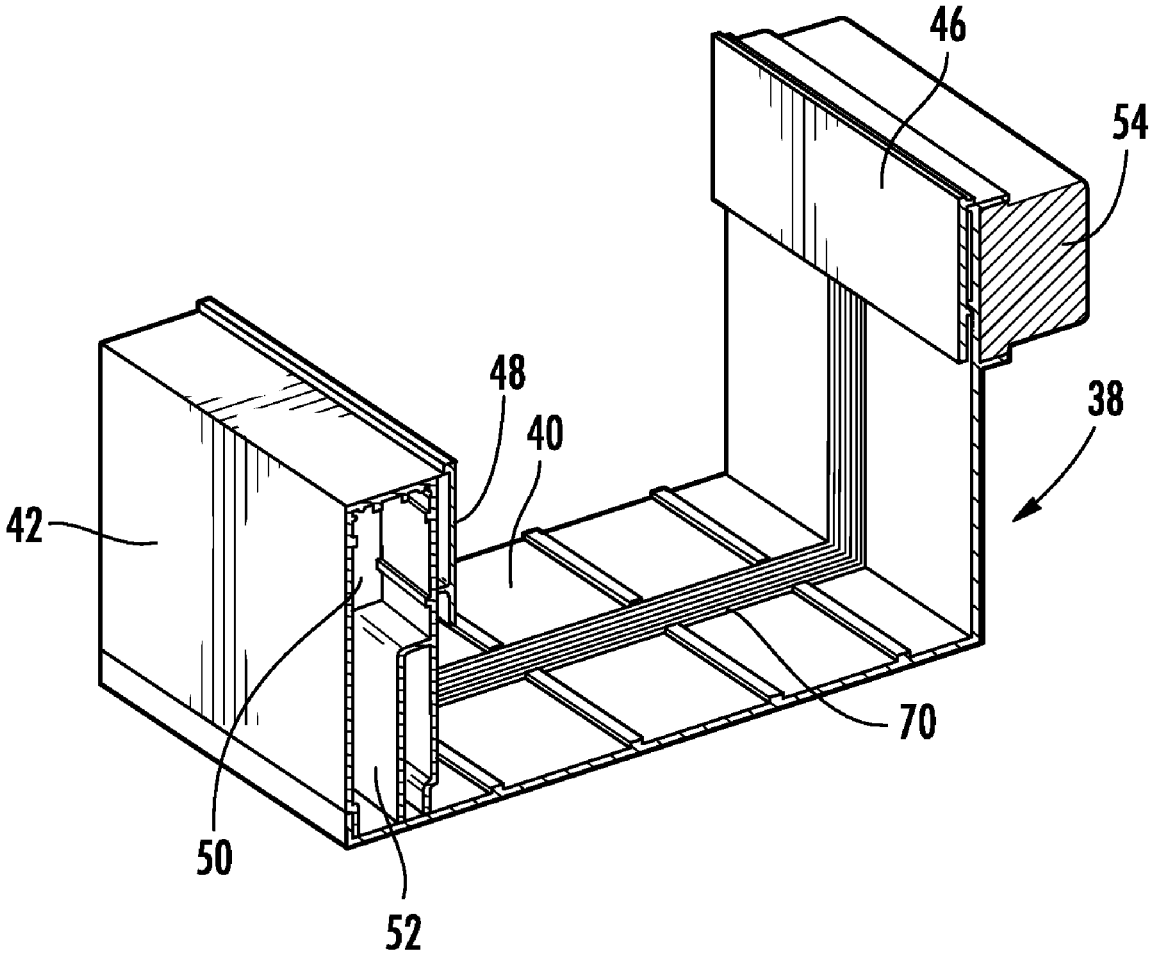
FIG. 19 is a pictorial view of the container sensor electronics module.
Figure 20:
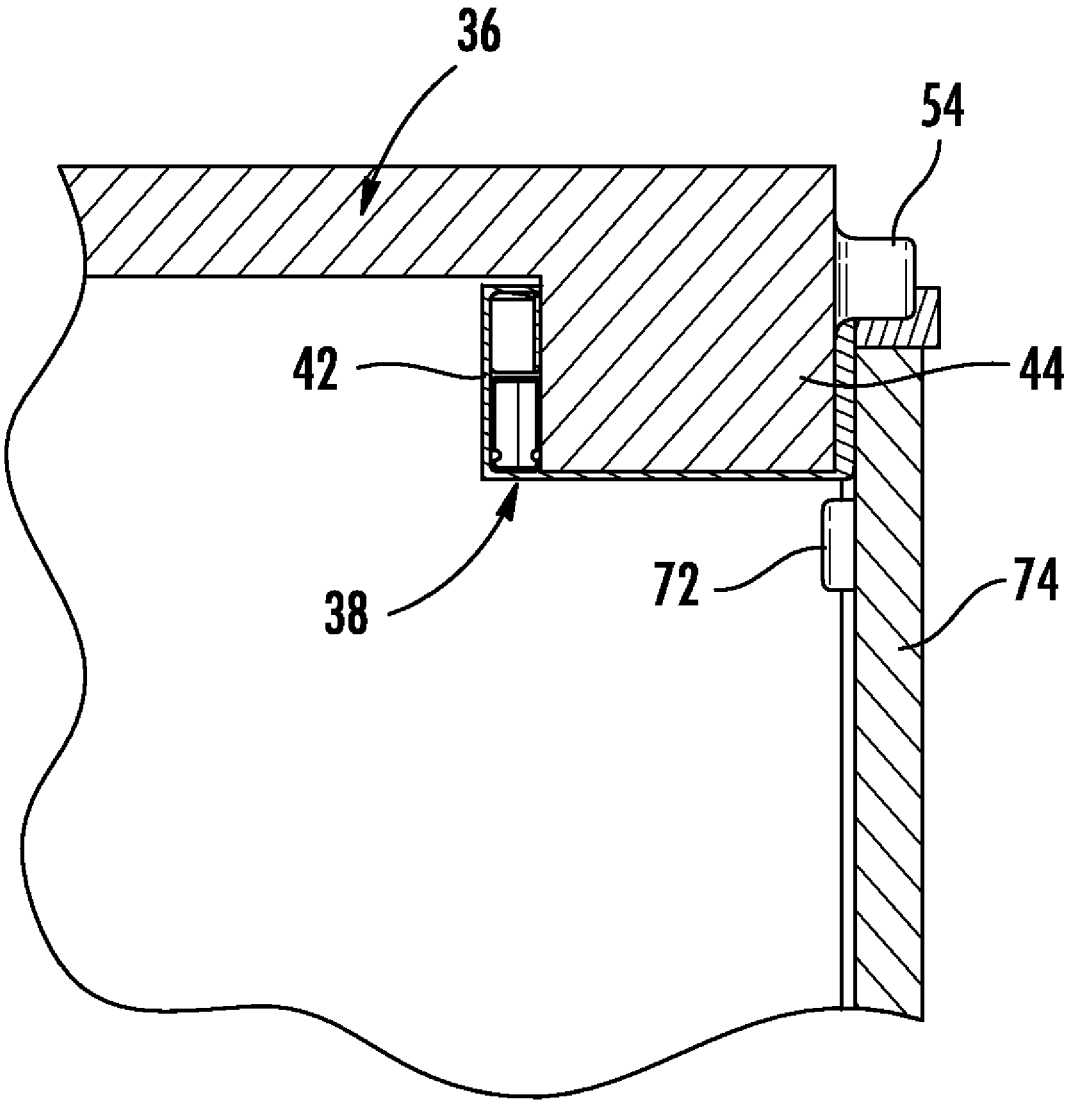
FIG. 20 is a sectional view of the shipping container shown in FIG. 1, and shows the container sensor electronics module mounted to the container, and the position of the RF door seal on the container door relative to that electronics module, when the door is closed.

An optional component of the system described here is a container sensor electronics module, generally indicated at 38 (see FIG. 19), which is mounted to the container 36. This optional module is made from two aluminum extrusions 40, 42 that are snap-fit together. The container sensor module 38 is mounted to a cross-wise door beam 44 on the container (see FIG. 20 and is adhered by using a pressure sensitive adhesive ("PSA") on surfaces 46, 48. When the unit 38 is first installed on the container 36, the PSA covering is removed from attachment surfaces 46, 48, and the extrusion is spread apart and placed on beam 44. Releasing the extrusion causes spring forces to press the PSA into the door beam 44. Once again, this mounting arrangement is best seen in FIG. 20, which depicts a corner cross-section of the container 36 and door structure.

The PSA-carrying surfaces 46, 48 are snap-fit to other parts of the electronics module 38. This allows the module 38 to be disconnected from the container beam 44, while leaving the surfaces 46, 48 in place, so that the module 38 can later be remounted to the container. Removal of the module 38 from the container is necessary from time to time to replace the battery 52, or to gain access to an electronics board module 52 and an antenna block 54 on opposite sides of the module 38 (see FIG. 19). This particular embodiment shows a single, exterior antenna block 54. However, the container electronics module 38 could be built with an interior antenna or both interior and exterior antennae, if desired.

The battery pack 50 is a typical two-cell battery pack that uses lithium cells capable of providing 3.6 volts output at 5000 milliamps. The electronics board module 52, inside the container sensor module 38, is a combination of electronics that includes specific sensors and digital data storage, similar to the seal electronics module 45 that locks the container door 74. Therefore, and referring now to FIG. 23, this electronics board 45 includes wireless transmission capability 56 (provided by a 2.4 GHz wireless modem—with the signal output via the antenna block 54), flash memory 58 for data storage (SM, typical), and humidity 60, temperature 62, and impact or vibration sensors 64, for detecting these conditions inside the container 36. It is to be appreciated that the electronic seal lock module 45 contains a similar set of sensors inside box 43, for the purpose of sensing environmental conditions at the door on the outside of container 36.

The electronics board 52 also has low power RF capability 66 for a door security sensor (explained further below), and may be modified to include still another sensor 68 that is capable of detecting changes in ambient light (i.e., daylight) inside the container. In other words, a change in interior lighting can be detected when the door is opened, under any circumstance, or if light should enter the container in some fashion because a hole is cut through a sidewall or roof. As previously indicated when the electronic seal lock module 45 was described above, the type of electronics unit 52 just described (for use in the container sensor module 38) is available on a customized basis from companies like TeraHop Networks, Inc. in Alpharetta, Ga.

Returning to FIG. 19, the electronics board 52 is connected to the antenna block 54 by a conventional ribbon cable 70. The ribbon cable is protected by covering it with PSA or similar material, which is not shown in the drawings. The antenna block 54 enables wireless data communication with a satellite uplink, or with a local area network, and also provides an RF link with an active RF door seal module 72 (see FIG. 18) mounted to the container door 74.

Figure 22:
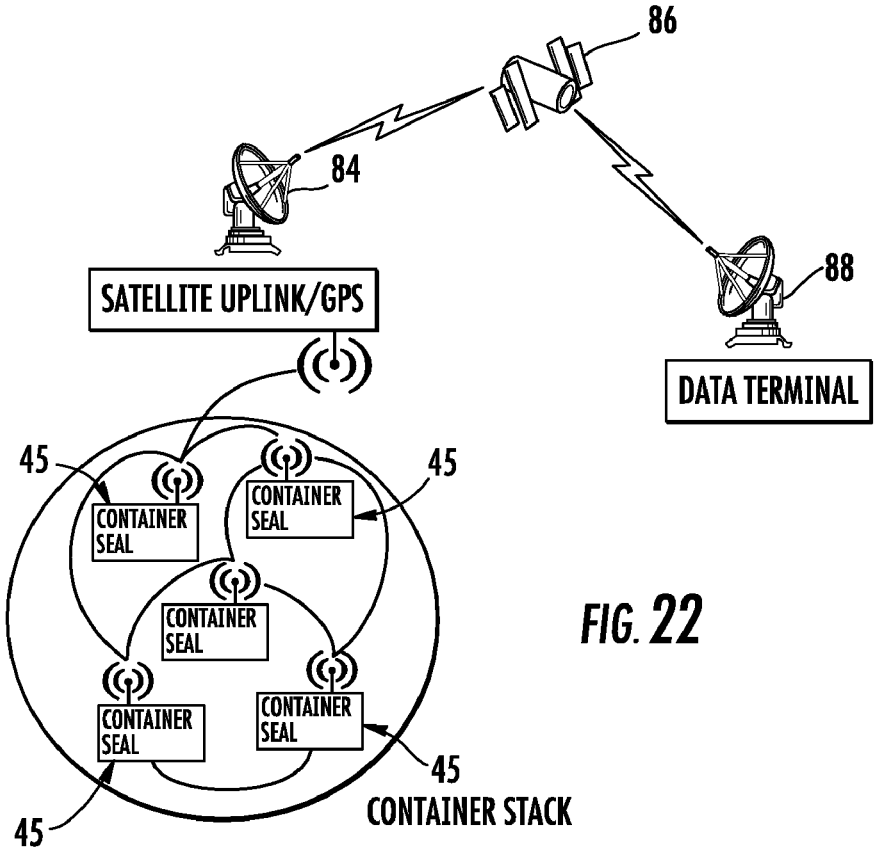

With respect to wireless networks, and referring again to FIG. 23, each electronic seal lock module 45 on a shipping container 36 will be in wireless communication with the container sensor electronics module 38 mounted to the shipping container. The electronic seal lock module 45 administrates the container sensor module described above, in preferred form (although it could be done the other way with the container module functioning as the administrator or the "master"), and stores shipping data, and stores and administrates other kinds of useful data a shipper may want or need. While data could be transmitted from any one of the three antenna sources described above (that is, the electronic seal lock 45; the sensor container module 38; and/or a third wireless antenna in the electronics module 34 inside the seal bolt's locking body 14), it is anticipated that the electronic seal lock 45 will provide the preferred transmission source. Therefore data of all kinds will be transmitted from antenna blocks 59, 61 on the housing 43 of the electronic seal lock (see FIGS. 8-11) to a centralized data base 88 via a satellite uplink 84, 86 as indicated in FIG. 22.

Figure 23:
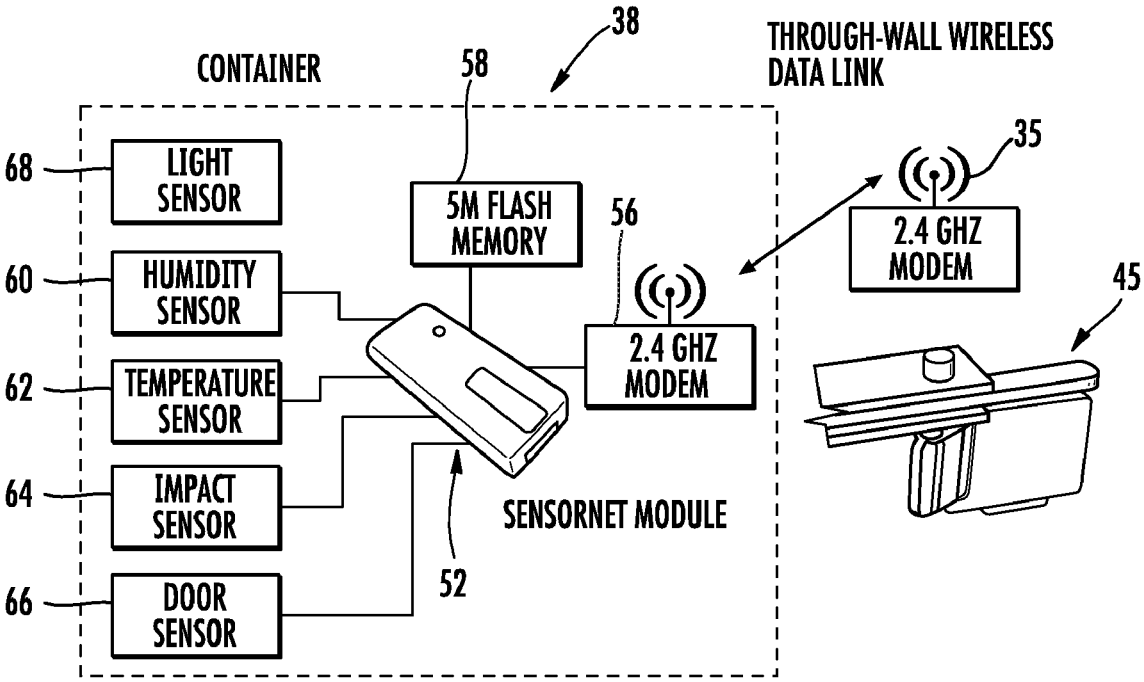
FIG. 23 is a schematic view that generally illustrates the sensing capability of the electronics module shown in FIG. 2 or FIG. 19, and also generally illustrates the wireless link between the electronics seal lock module and the container sensor electronics module, and the wireless link between these components and a satellite uplink.

And, once again, as schematically indicated in FIG. 23, in addition to transmitting data to a centralized database, via an uplink, the antenna blocks 59, 61 also enable the electronic seal lock module 45 to communicate with the wireless modem 56 inside the container sensor module 38. This enables virtually all of the data available in the electronic seal lock module 45 to be communicated to and exchanged with the container sensor module 38 on an ongoing basis.

Shipping information, for example, may be easily downloaded from the seal lock 45 by a handheld device, and even via a USB port 76 on the locking body 14, if desired, in essentially the same way as previously described in the '300 application, or by wireless transmission directly from the internal electronics inside the seal lock module 45.

By combining the electronic seal lock module 45 as a component in a larger system that includes the container sensor module 38, it expands upon the type of useful information that may be communicated and made accessible through the seal lock module 45. It is important to understand that any of the data available in the electronic seal lock 45 is duplicated and resident in the container electronics module 38, and it can be done in reciprocal fashion (data acquired by one device is shared with and duplicated by the other). This is important when a security breach arises. While there are different ways of entering a container, the simple fact of the matter is that both authorized and unauthorized container entry is usually accomplished by simply cutting the bolt 12 on the bolt lock 10 portion of the electronic seal module 45.

When the bolt 12 is cut by a thief, the seal lock module 45 may be removed, as well. The container subsequently arrives at the destination with clear evidence of tampering, but possibly with the entire module 45 missing (which means the electronic data stored in the seal lock is also missing). In the design disclosed here, unless the thief overtly attempts to destroy the container sensor electronics module 38, then all of the necessary data will still remain resident with the container when it arrives and, as a consequence, can be downloaded. Not only can conventional shipping information be accessed to identify what is missing from the container relative to what should be there, but it would be possible to determine the time of entry and even the likely location.

Moreover, the antenna block 54 and 59 and 61 on these two container sensor and electronic seal lock modules respectively enable ongoing communication between each electronics module and a centralized data base provider, via the Internet or similar network. This mode of communication is conventional and well-known. In the case of the typical ship that carries containers, the ship is likely to have uplink capability to a satellite. Therefore, if the master electronics module is in ongoing communication with a network, it would be possible to instantaneously transmit data at about the time the container door is opened or another type of unauthorized access is detected.

Figure 18:
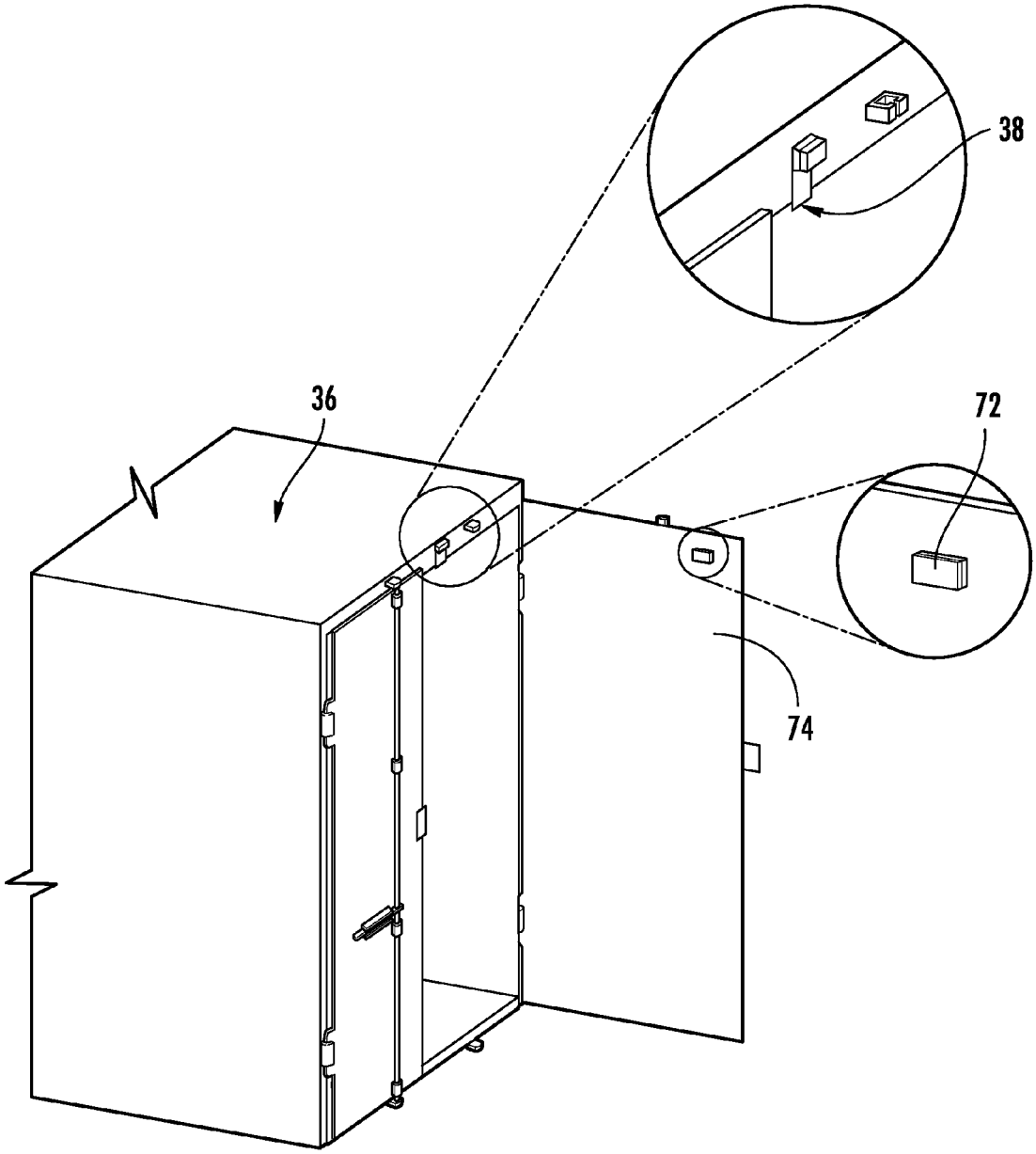
FIG. 18 is similar to FIG. 1, but shows the container door open to better illustrate the location of the container sensor electronics module.

With respect to door security, when the container door 74 is closed, the antenna block 54 on the container sensor electronics module 38 is in active communication with RF door seal module 72 (mounted inside the door 74). This arrangement is best seen in FIG. 18, which shows a cross-section of the door 74 closed relative to a cross-section of the container 36.

If the door 74 is swung open, then the resultant lack of physical proximity between antenna block 54 and door seal module 72 can be detected and used to generate a signal and data that reflects that the door was opened. As per the previous description, it would be possible for the sensor electronics module 38 to keep track of "when" and "for how long."

To describe typical operation of the above system, the container sensor electronics module 38 is coded to the RF door seal 72 so that no other RF seal will give a correct response code to that particular electronics module 38. When a container is loaded and ready to be sealed, the sensor electronics module 38 is equipped with a reset or synchronization button (not shown in the drawings) that "reads" and synchronizes with electronic seal lock module 45 on the door. These two devices are uniquely coded to each other and the container doors are closed.

The seal lock housing 43 can be provided with a flashing LED indicator that indicates all system components are linked wirelessly together. At that point, the bolt 12 may be installed on the container door. When seal lock 10 is installed on the container door 74, the electronic serial number provided by the chip 17 is recorded by both the electronic seal lock module 45 and the container sensor module 38. This is to prevent tampering or replacement of the seal lock 10 during shipping.

An advantage to the system described here is that it provides an automatic update of serial numbers when new seal bolts are installed. Other advantages include multiple redundancies and also a medium for communicating data from shipping containers that is unique. One type of redundancy lies in using the electronic sensor module 45 as a data storage device with its own independent wireless transmission capability. This allows the container sensor module 38 to communicate with its respective seal lock module 45 on the container 36, as described above, but it also enables seal lock modules to communicate with each other, if desired, when multiple numbers of the same type of seal lock are used on stacked containers.

Figure 21:
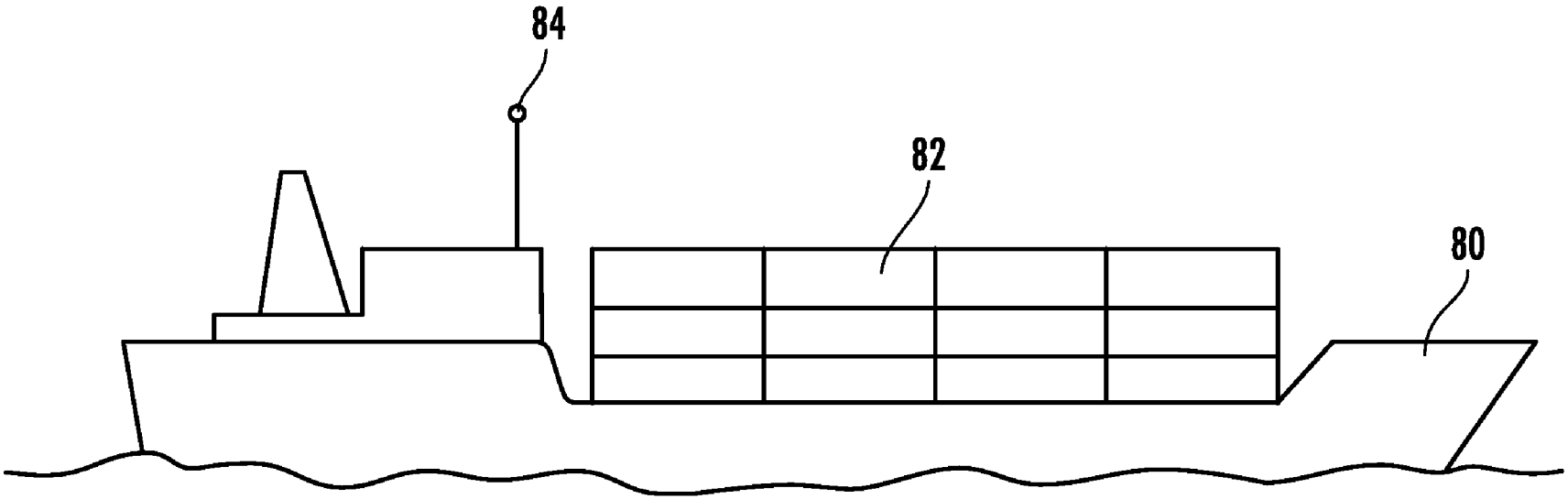
FIG. 21 is a side schematic of a cargo vessel that is loaded with containers.

Referring now to FIGS. 21 and 22, it is known to communicate data wirelessly from cargo containers, trailers, railcars, etc. However, when large groups of containers are stacked on a ship 80, as shown at 82 in FIG. 21, the metal walls of the group makes it difficult or impossible to transmit wireless data out through the ship's antenna 84 from those containers that are buried deeply within the stack. It is possible to use individual electronic seal lock modules 45, constructed in the way described here, as communication nodes, or combine them into a nodal communication network as schematically illustrated in FIG. 22. While the signal from an individual antenna on a container buried deeply in a stack may not be strong enough to reach the ship's antenna, it will be strong enough to reach the antenna on a nearby seal lock module 45. In this way, location and shipping data can be passed through seal locks, from one to the next as needed, until the data is received and broadcast through the ship's antenna, or a satellite uplink 84, to first a satellite 86 and then to a centralized data base 88. In this way, a supply chain manager can locate all of the containers on a ship as needed, even if the container sought by the supply chain manager is covered by many other containers.

Figure 24:
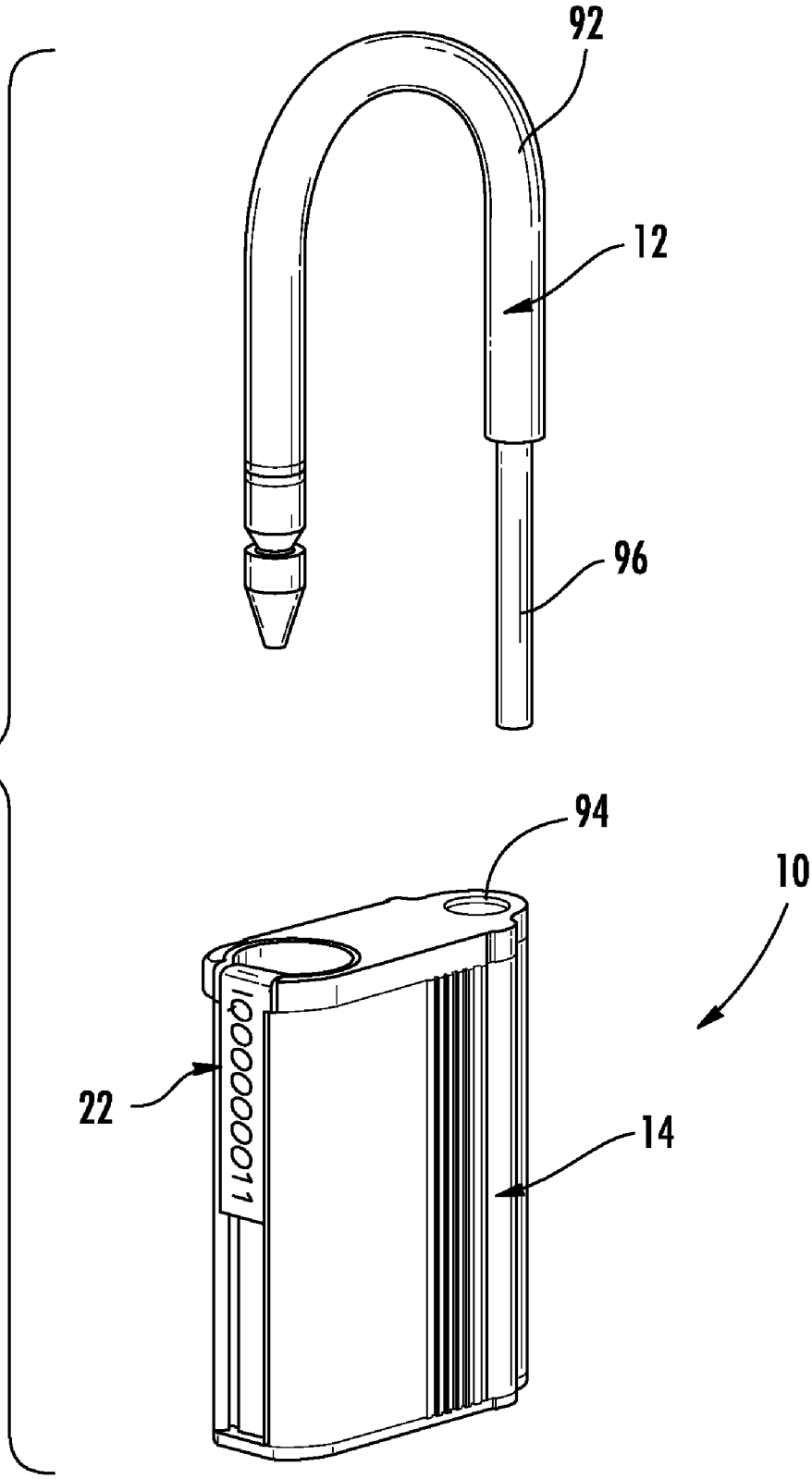
FIG. 24 is an alternative embodiment of just the bolt and locking body component of the electronic seal lock module.
Figure 25:
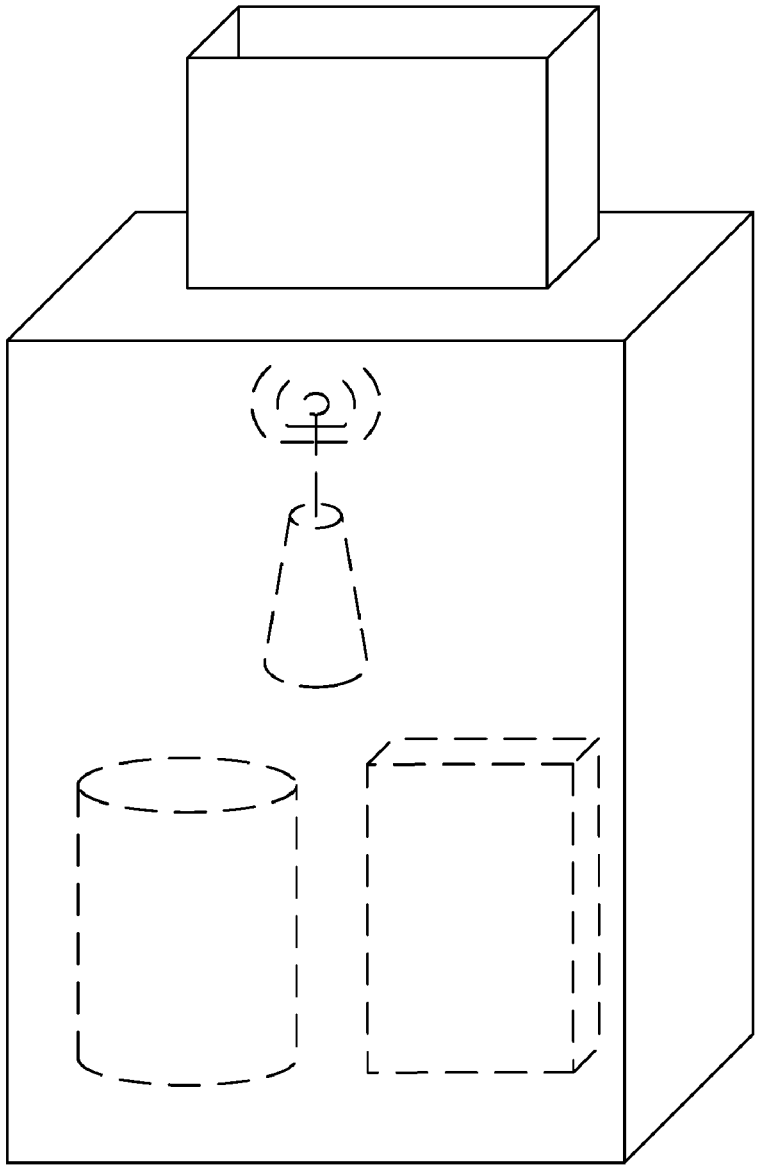
FIG. 25 is an enlarged drawing of the electronics module shown in FIG. 4, showing various internal components including memory, a wireless communications component, and a power source.

Finally, FIG. 24 shows further variations of the seal lock relative to the disclosure made in the '300 patent application. This Fig. shows a modified version of the seal lock 10 where the bolt 12 is replaced with a standard "U" shaped bolt that is found on padlocks. This variation works in the same way, except that the locking body 14 is modified to have an opening 94 for receiving a pin 96 on the bolt 92. The mechanical bolt part may be modified in other ways as well. In this description, the bolt lock 10 is described as having its own electronics module 34. If this component is retained, then it creates a third redundant source for data storage, if desired. It may not be needed when the bolt lock design is integrated with the electronics box 43 described above. It is likely to be included if bolt locks 10 are supplied as independent devices and used in essentially the way they have been traditionally used—i.e., the manner described in the '300 application.

It is believed that the system described here will provide many advantages to those shippers who rely on electronic tracking of shipped goods. The foregoing description sets forth the current best description of the invention and is not necessarily intended to limit the scope of the patent right. The designs and embodiments disclosed here are in the process of being improved upon. It is conceivable that, as technology changes, certain components described above may be improved upon, or evolve, without departing from the spirit and scope of the invention and its advantages as described above. Therefore, the scope of patent protection is not to be limited by the specifics of the foregoing description. Instead, the scope of the right is to be limited in accordance with the applicable doctrines relating to patent interpretation.

What is claimed is:

1. A seal lock, comprising:

(a) a bolt comprising, (i) a shaft having a proximal portion and a distal portion, and (ii) a head located at the proximal portion of the shaft, the head being wider than the distal portion of the shaft;

(b) a locking body having a passageway with an open end for receiving and retaining the distal portion of the shaft of the bolt in locking engagement after the shaft has been inserted a predetermined extent into the open end of the passageway, at which point the shaft cannot be withdrawn from the open end of the passageway; and (c) a housing connected to the locking body such that the housing and locking body are rotatable relative to each other, the housing configured to be removably mounted to a door of a shipping container, whereby the locking body does not freely swing on the distal portion of the shaft of the bolt during movement of the shipping container;

(d) wherein the housing contains electronics therein, the electronics including, (i) memory for storing data, (ii) a wireless communication component configured to wirelessly communicate data, and (iii) a power source for powering the wireless communication component; and (e) wherein the housing and locking body are rotatable relative to each other about a first axis, and wherein the passageway of the locking body extends along a second axis that is parallel to the first axis.

2. The seal lock of claim 1, wherein the housing comprises magnets configured to magnetically mount the housing to a door of a shipping container.

3. The seal lock of claim 1, wherein the electronics of the housing further include a microprocessor.

4. The seal lock of claim 1, wherein the electronics of the housing further include one or more sensor components for acquiring data for detecting an environmental condition external to the housing.

5. The seal lock of claim 4, wherein the electronics of the housing further include a microprocessor configured to process the sensor-acquired data.

6. The seal lock of claim 4, wherein the electronics are configured to detect motion, vibration, impact or shock.

7. The seal lock of claim 4, wherein the electronics are configured to detect humidity.

8. The seal lock of claim 4, wherein the electronics are configured to detect temperature.

9. The seal lock of claim 1, further comprising an antenna secured to the housing and configured to facilitate wireless communications by the wireless communication component contained within the housing.

10. The seal lock of claim 1, further comprising two antennas each respectively secured to an opposite side of the housing and configured to facilitate wireless communications by the wireless communication component contained within the housing.

11. The seal lock of claim 1, wherein the passageway of the locking body further includes a second open end and is configured to permit passage of the distal portion of the shaft through and out of the second open end of the passageway after separation of the head and the distal portion of the shaft of the bolt.

12. The seal lock of claim 11, wherein the locking body includes a locking mechanism comprising a snap ring, and wherein the shaft of the bolt includes two circumferential, sloped surfaces, each surface being configured to engage and expand a snap ring of the locking body when the distal portion of the shaft of the bolt is pushed through the passageway in a direction from the first open end toward the second open end.

13. The seal lock of claim 11, wherein the locking body is configured, after passage of the distal portion of the shaft through and out of the second end of the passageway, to receive and retain a shaft of another bolt in the locking engagement after the shaft of the other bolt has been inserted a predetermined extent into the first open end of the passageway, at which point the shaft of the other bolt cannot be withdrawn from the first open end of the passageway, whereby the locking body is reusable and a shipping container sealed by the bolt-type seal lock can be opened and relocked in the field using the locking body.

14. The seal lock of claim 1, wherein the locking body contains electronics therein, the electronics including, (a) memory for storing data, (b) a wireless communication component configured to wirelessly communicate data, and (c) a power source for powering the wireless communication component.

15. The seal lock of claim 14, wherein the electronics of the locking body further include a USB port that is externally accessible for reading data from the memory contained within the locking body.

16. The seal lock of claim 14, wherein the wireless communication component of the locking body and the wireless communication component of the housing are configured for wireless communications with each other.

17. A method of securing a shipping container, comprising the steps of:

(a) providing a bolt-type seal lock, comprising, (i) a bolt comprising, (A) a shaft having a proximal portion and a distal portion, (B) a head located at the proximal portion of the shaft, the head being wider than the distal portion of the shaft, and (C) a microchip that electronically contains a unique serial number of the bolt, (ii) a locking body having an open-ended passageway, and (iii) a housing connected to the locking body such that the housing and locking body are rotatable relative to each other, the housing configured to be removably mounted to a door of a shipping container, whereby the locking body does not freely swing on the distal portion of the shaft of the bolt during movement of the shipping container, the housing containing electronics including, (A) memory for storing data, (B) a wireless communication component configured to wirelessly communicate data, and (C) a power source for powering the wireless communication component;

(b) inserting the distal end of the shaft of the bolt, (i) through an opening in a locking structure of a door of the shipping container such that the shaft of the bolt must be withdrawn from the opening of the hasp in order to open the door of the shipping container without causing structural damage to the shipping container, the head of the bolt being too wide to pass through the opening in the locking structure of the door of the shipping container, and (ii) into an open end of the passageway of the locking body a predetermined extent such that the locking body receives and retains the shaft of the bolt in locking engagement therewith; and (c) after the locking engagement of the bolt with the locking body, reading the serial number from the microchip, storing the serial number in the memory of the housing, and wirelessly communicating the serial number from the housing the wireless communication component of the housing.

18. The method of securing a shipping container according to claim 17, further comprising the steps of, (a) removing the bolt from the locking body;

(b) providing a second bolt, comprising, (i) a shaft having a proximal portion and a distal portion, (ii) a head located at the proximal portion of the shaft, the head being wider than the distal portion of the shaft, and (iii) a microchip that electronically contains a serial number of the second bolt;

(c) inserting the distal end of the shaft of the second bolt, (i) through the opening in the locking structure of the door of the shipping container such that the shaft of the second bolt must be withdrawn from the opening of the hasp in order to open the door of the shipping container without causing structural damage to the shipping container, the head of the second bolt being too wide to pass through the opening in the locking structure of the door of the shipping container, and (ii) into an open end of the passageway of the locking body a predetermined extent such that the locking body receives and retains the shaft of the second bolt in the locking engagement therewith; and (d) after the locking engagement of the second bolt with the locking body, reading the serial number of the second bolt from the microchip of the second bolt, storing the serial number of the second bolt in the memory of the housing, and wirelessly communicating the serial number of the second bolt from the housing the wireless communication component of the housing.

* * * * *